US008162569B2

(12) United States Patent
Kennedy et al.

(10) Patent No.: US 8,162,569 B2
(45) Date of Patent: Apr. 24, 2012

(54) HIGH-STRENGTH ANCHOR SYSTEM, SAFE ROOM BULKHEAD, AND METHOD OF ANCHORING A SUPPORT TO MINE STRATA

(75) Inventors: William R. Kennedy, Taylorville, IL (US); John M. Kennedy, Taylorville, IL (US)

(73) Assignee: Kennedy Metal Products & Buildings, Inc., Taylorville, IL (US)

( * ) Notice: Subject to any disclaimer, the term of this patent is extended or adjusted under 35 U.S.C. 154(b) by 134 days.

(21) Appl. No.: 12/795,795

(22) Filed: Jun. 8, 2010

(65) Prior Publication Data

US 2011/0297057 A1 Dec. 8, 2011

(51) Int. Cl.
*E02D 29/00* (2006.01)
*E21D 21/00* (2006.01)

(52) U.S. Cl. ..... 405/302.1; 405/288; 405/272; 405/132; 299/11; 299/12

(58) Field of Classification Search ..... 405/132, 405/144, 259.1, 272, 288, 302.1; 299/11, 299/12

See application file for complete search history.

(56) References Cited

U.S. PATENT DOCUMENTS

| | | | | |
|---|---|---|---|---|
| 3,257,765 | A * | 6/1966 | Anderson et al. | 52/298 |
| 3,293,811 | A * | 12/1966 | Rice | 52/223.13 |
| 3,415,064 | A * | 12/1968 | Talobre | 405/302.1 |
| 4,483,642 | A | 11/1984 | Kennedy | |
| 4,547,094 | A | 10/1985 | Kennedy | |
| 4,820,081 | A | 4/1989 | Kennedy | |
| 4,911,577 | A | 3/1990 | Kennedy | |
| 5,505,033 | A | 4/1996 | Matsuo | |
| 6,032,986 | A | 3/2000 | Kennedy | |
| 6,164,871 | A | 12/2000 | Kennedy | |
| 6,379,084 | B1 | 4/2002 | Kennedy | |
| 6,457,906 | B1 | 10/2002 | Kennedy | |
| 6,536,990 | B2 * | 3/2003 | Schubert et al. | 405/302.1 |
| 6,594,954 | B1 | 7/2003 | Kennedy | |
| 6,682,263 | B2 * | 1/2004 | Kennedy et al. | 405/132 |
| 6,688,813 | B2 | 2/2004 | Kennedy | |
| 6,846,132 | B2 | 1/2005 | Kennedy | |
| 7,267,505 | B2 | 9/2007 | Kennedy | |
| 7,393,025 | B2 | 7/2008 | Kennedy | |
| 7,510,351 | B2 * | 3/2009 | Price et al. | 405/302.1 |
| 2004/0115010 | A1 * | 6/2004 | Robertson et al. | 405/259.1 |
| 2004/0131428 | A1 * | 7/2004 | Henderson | 405/231 |

FOREIGN PATENT DOCUMENTS

KR 603367 * 7/2006

OTHER PUBLICATIONS

Minova Americas, Anchoring Products/Lokset(R) Toospeedie Resin Cartridge, Oct. 2009, 2 pages.

* cited by examiner

*Primary Examiner* — Frederick L Lagman
(74) *Attorney, Agent, or Firm* — Senniger Powers LLP

(57) ABSTRACT

A high-strength anchor system for anchoring a support to mine strata is disclosed. The system includes an anchor plate and a connecting member on the anchor plate for connection of the support to the anchor plate. Anchor bolts extend through bolt holes in the anchor plate into bore holes in the mine strata. Load-spreading devices extend from respective bolt holes in the anchor plate into the bore holes. The load-spreading devices have outside diameters larger than outside diameters of the anchor bolts for spreading shear loads exerted on the anchor bolts over larger areas of the mine strata. A method of installing such a system and a safe room bulkhead using such a system are also disclosed.

28 Claims, 35 Drawing Sheets

HIGH-STRENGTH ANCHOR SYSTEM, SAFE ROOM BULKHEAD, AND METHOD OF ANCHORING A SUPPORT TO MINE STRATA

FIELD OF THE INVENTION

The present invention generally relates to a system for anchoring a support to mine strata, and more particularly to such a system which is able to withstand high loads, as encountered during a mine explosion.

BACKGROUND OF THE INVENTION

A system of this invention has particular (albeit not exclusive) application in the installation of "safe room" bulkheads for use in a mine. A "safe room" is a room formed in mine, usually by mining an adit that requires a fourth wall or bulkhead to enclose the room. When the bulkhead is in place, the room provides a refuge for miners immediately after a mine explosion has taken place. The safe room is equipped for life support, similar to a mobile refuge chamber installed in a mine for the same purpose. U.S. Pat. No. 7,533,942, assigned to Kennedy Metal Products & Buildings, Inc. of Taylorville, Ill., describes one such refuge chamber.

The bulkhead of a safe room must be able to withstand high pressures resulting from a mine explosion. While the structure of the bulkhead itself can be constructed to withstand such pressures, the mine strata to which it is attached adjacent the entrance to the safe room is relatively weak. Conventional means for attaching the bulkhead to the mine strata are generally inadequate to withstand the pressures generated by an explosion. As a result, an explosion may cause failure of the attachment and degradation of the safe room.

SUMMARY OF THE INVENTION

This invention is directed to, among other things, a high-strength anchor system for anchoring a support to mine strata. The system comprises an anchor plate adapted to be secured to mine strata with an outer face of the plate facing the mine strata and an inner face of the plate facing away from the mine strata, and a connecting member on the inner face of the anchor plate for connection of the support to the anchor plate. Anchor bolt holes are spaced at intervals around the plate. Anchor bolts extend through the bolt holes into bore holes in the mine strata. Fasteners secure the anchor plate to the anchor bolts. Load-spreading devices extend from respective bolt holes in the anchor plate into respective bore holes in the mine strata. The load-spreading devices have outside diameters larger than outside diameters of the anchor bolts for spreading shear loads exerted on the anchor bolts over larger areas of the mine strata.

This invention is also directed to, among other things, a high-strength anchor unit for anchoring a support to mine strata. The anchor unit comprises an anchor plate adapted to be secured to mine strata with an outer face of the plate facing the mine strata and an inner face of the plate facing away from the mine strata, and a connecting member on the inner face of the anchor plate for connection of the support to the anchor unit. Anchor bolt holes are spaced at intervals around the anchor plate for receiving anchor bolts extending into bore holes in the mine strata. Load-spreading sleeves extend from respective bolt holes in the anchor plate for reception in respective bore holes in the mine strata. The sleeves have inside diameters sized for receiving respective anchor bolts and outside diameters greater than the inside diameters for spreading shear loads exerted on the anchor bolts over larger areas of the mine strata.

This invention is also directed to, among other things, a method of anchoring a support to mine strata. The method comprises placing an anchor unit on the mine strata, using bolt holes in the anchor unit as guides to drill bore holes in the mine strata, and inserting anchor bolts through the bolt holes into respective bore holes. The method also involves surrounding each anchor bolt with a load-spreading device having an outside diameter greater than the outside diameter of the anchor bolt for spreading shear loads exerted on the anchor bolts over larger areas of the mine strata, and fixing the anchor bolts in the bore holes. The anchor plate is secured to the anchor bolts in preparation for connecting a support to the anchor plate.

This invention is also directed to, among other things, a bulkhead for a safe room in a mine. The bulkhead comprises a wall structure extending between side walls of the safe room, a support supporting the wall, and an anchor system anchoring the support to mine strata. The anchor system comprises an anchor plate anchored to the mine strata with an outer face of the plate facing outside of the safe room and an inner face of the plate facing inside the safe room, and a connecting member on the inner face of the anchor plate connecting the support to the anchor plate. Anchor bolt holes are spaced at intervals around the plate, and anchor bolts extend through respective anchor bolt holes into bore holes in the mine strata. Fasteners secure the anchor plate to the anchor bolts. Load-spreading devices extend from respective anchor bolt holes in the anchor plate into respective bore holes. The load-spreading devices have outside diameters larger than outside diameters of the anchor bolts for spreading shear loads exerted on the bolts over larger areas of the mine strata.

Other objects and features will be in part apparent and in part pointed out hereinafter.

BRIEF DESCRIPTION OF THE DRAWINGS

Corresponding reference characters indicate corresponding parts throughout the drawings.

DETAILED DESCRIPTION

Figure 1:
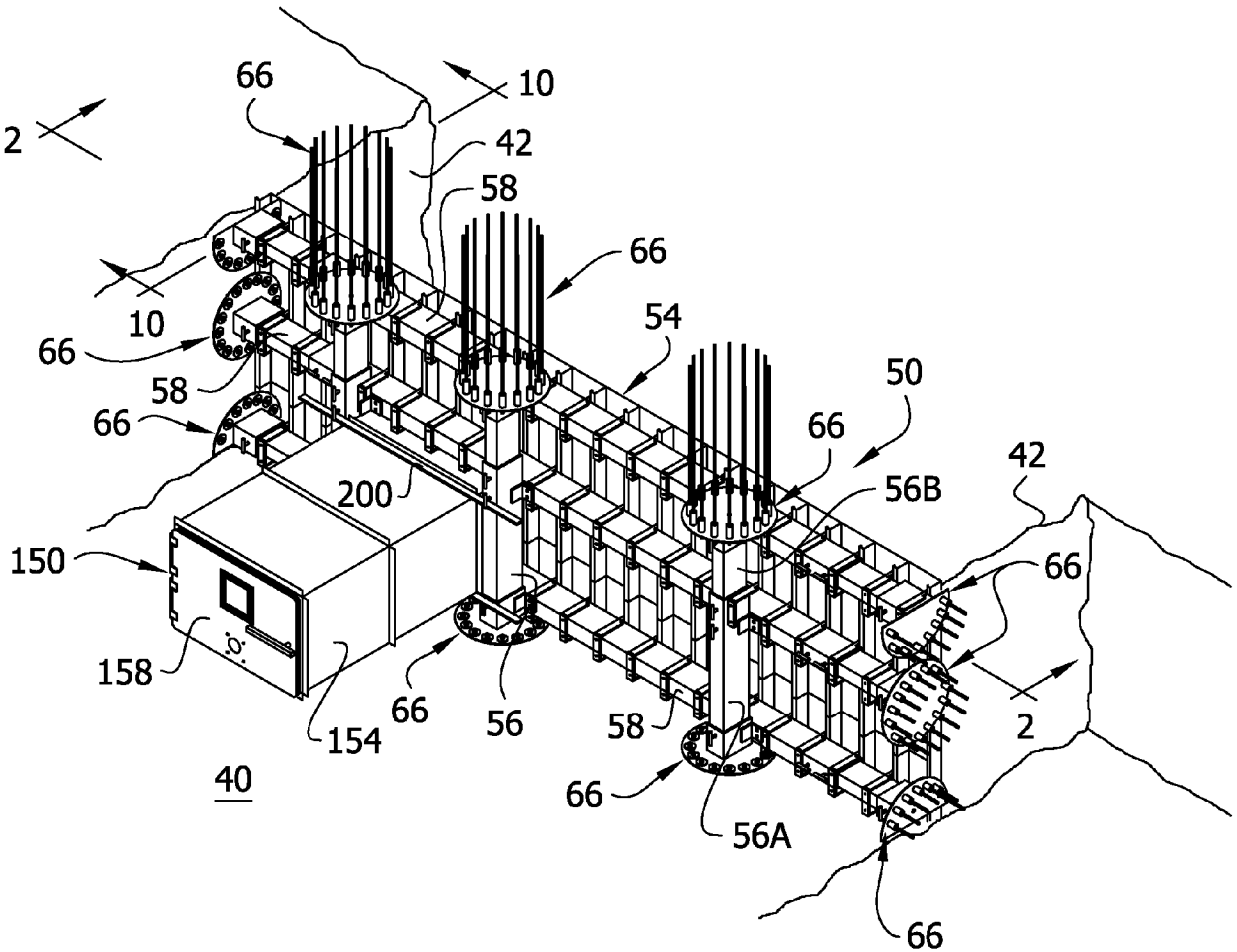
FIG. 1 is a top perspective of a safe room bulkhead installed using a high-strength anchor system of this invention.
Figure 2:
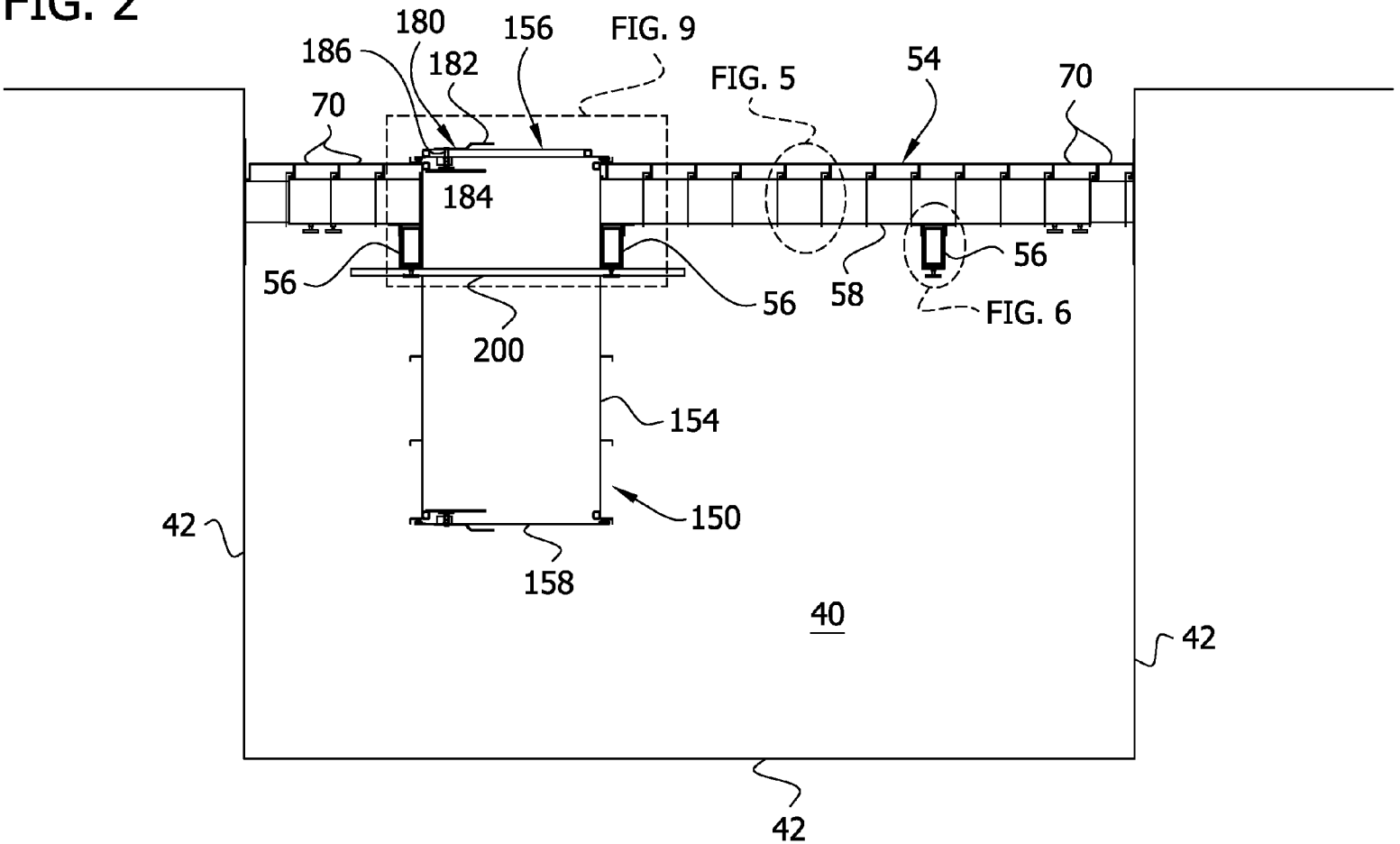
FIG. 2 is a horizontal section taken in the plane of line 2-2 of FIG. 1.

Referring now to the drawings, FIGS. 1-4 show a safe room 40 having three sides 42, a roof 44, and a floor 46, all 46 defined by mine strata. (The two opposing sides 42 shown in FIGS. 1 and 2 are interchangeably referred to herein as sides, ribs, and side walls.) A fourth side of the room is closed by a bulkhead, generally designated 50. In general, the bulkhead 50 comprises a wall structure 54 and a number of supports comprising vertical columns 56 and horizontal girders 58 supporting the wall structure. The supports 56, 58 are anchored to the mine strata by high-strength anchor units 66 to provide the strength necessary to withstand high-pressure forces exerted on the wall structure 54, as during a mine explosion.

Figure 3:
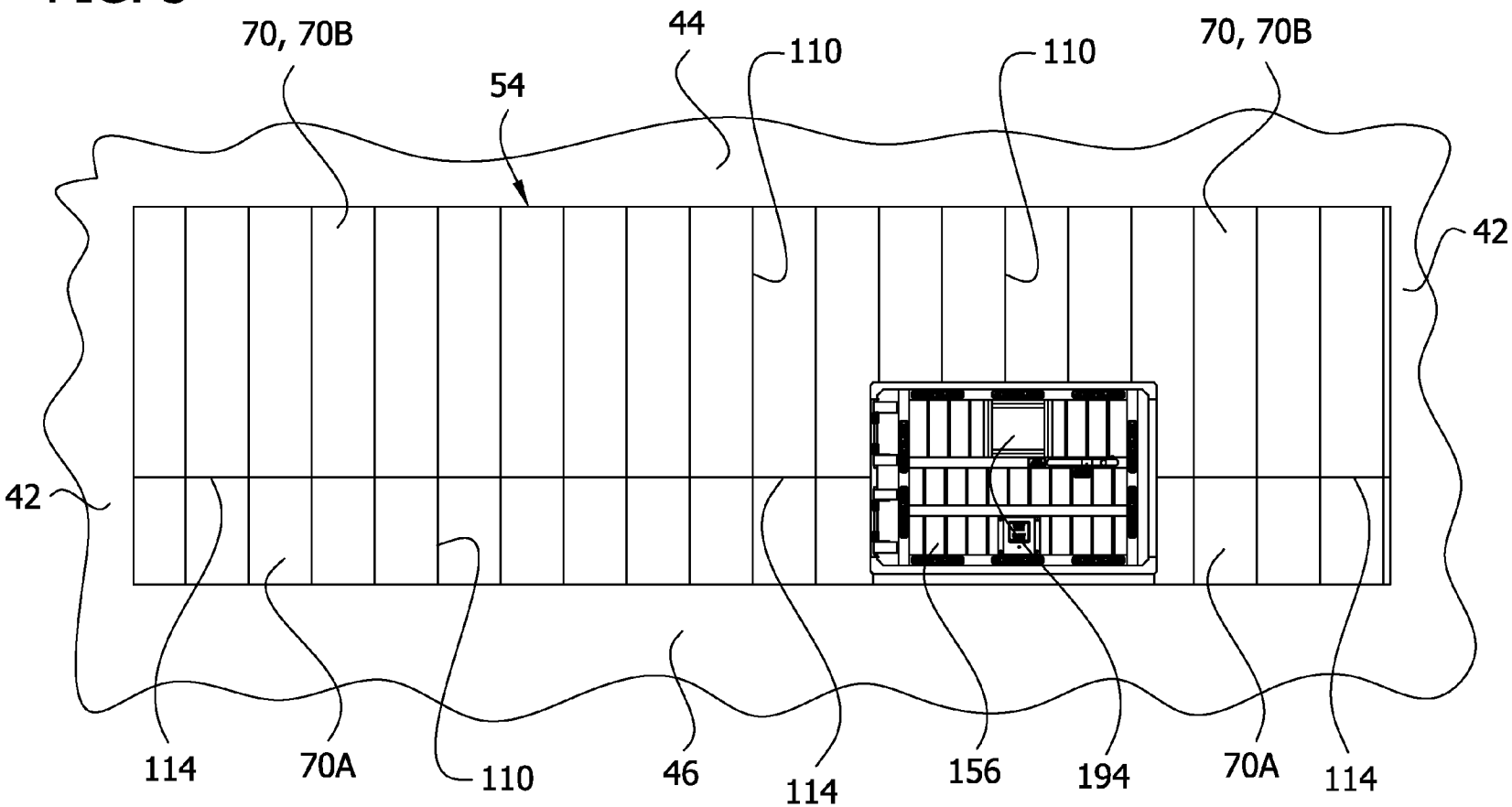
FIG. 3 is a front elevation of the bulkhead from outside the safe room.
Figure 4:
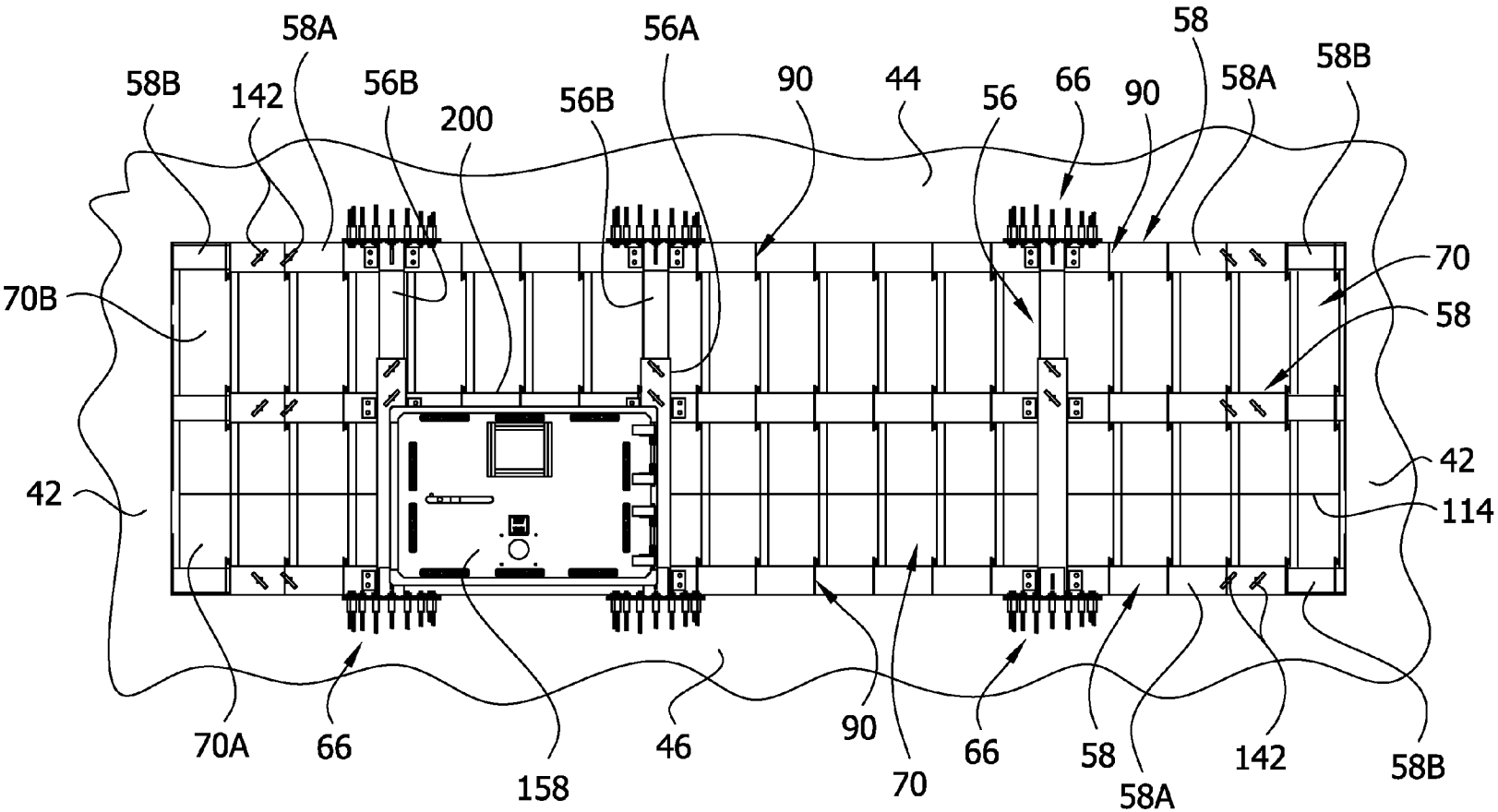
FIG. 4 is a rear elevation of the bulkhead from inside the safe room.

The wall structure 54 can be formed in any suitable manner, such as by the panel systems disclosed in U.S. Pat. Nos. 4,483,642, 4,547,094, 4,820,081, 4,911,577, 6,379,084, 6,688,813, 6,846,132, and 7,267,505, each of which is incorporated herein by reference for all purposes not inconsistent with this disclosure. In the illustrated embodiment, the wall structure 54 comprises a plurality of elongate extensible panels 70 extending vertically in side-by-side relation from the floor 46 to the roof 44 of the room 40. Each of the panels 70 is preferably (but not necessarily) constructed of two panel members, namely, a first elongate member 70A constituting a lower panel member having a lower end that engages the floor 46 of the room 40, as shown in FIG. 3, and a second elongate member 70B constituting an upper panel member having an upper end that engages the roof 44 of the room.

Figure 6:
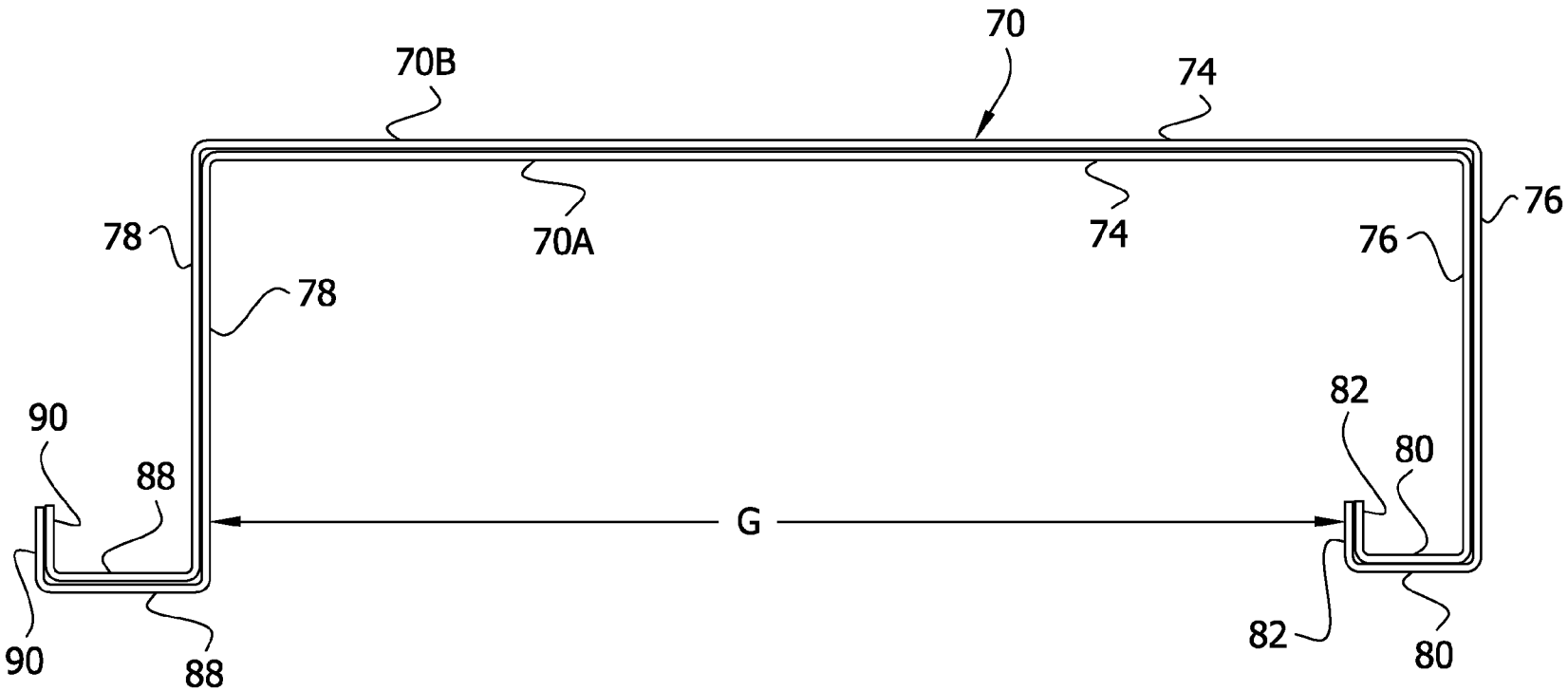
FIG. 6 is a view showing upper and lower panel members of a panel of FIG. 5 fitted together.

Each panel member 70 is a sheet metal member which, in the illustrated embodiment, is generally of channel shape in cross section, having a web 74 and first and second stiffening flanges 76, 78 at opposite sides of the web. As shown in FIG. 6, the first flange 76 has an in-turned portion 80 at its outer edge extending generally toward the second flange 78 and generally parallel to the web 74, and a lip 82 at the inner edge of the in-turned portion extending toward the web. The first flange 76 terminates short of the second flange 78 to form a gap therebetween, indicated at G in FIG. 6. The second flange 78 has an out-turned portion 88 at its outer edge extending generally away from the first flange 76 and generally in the same plane as the in-turned portion 80 of the first flange, and a lip 90 at the outer edge of the out-turned portion 88 extending generally in the same direction and generally parallel to the lip 82 of the first flange. In one embodiment, the lip 82 of first flange 76 extends closer to the web 74 than the lip 90 of the second flange 78, i.e., and the first flange 76 has a transverse dimension or width greater than the transverse dimension or width of the second flange 78, as fully described in co-assigned U.S. Pat. No. 7,267,505. The lower panel member 70A has a telescoping fit in the respective upper panel member 70B, the webs 74 of the members being in sliding engagement. (This could be reversed—the upper panel member 70B having sliding fit in the lower panel member 70A.) The panel members 70A, 70B could have other cross sectional shapes, such as a generally Z-cross sectional shape. The panel 70 could also be fabricated as a single panel member or more than two panel members.

Figure 5:
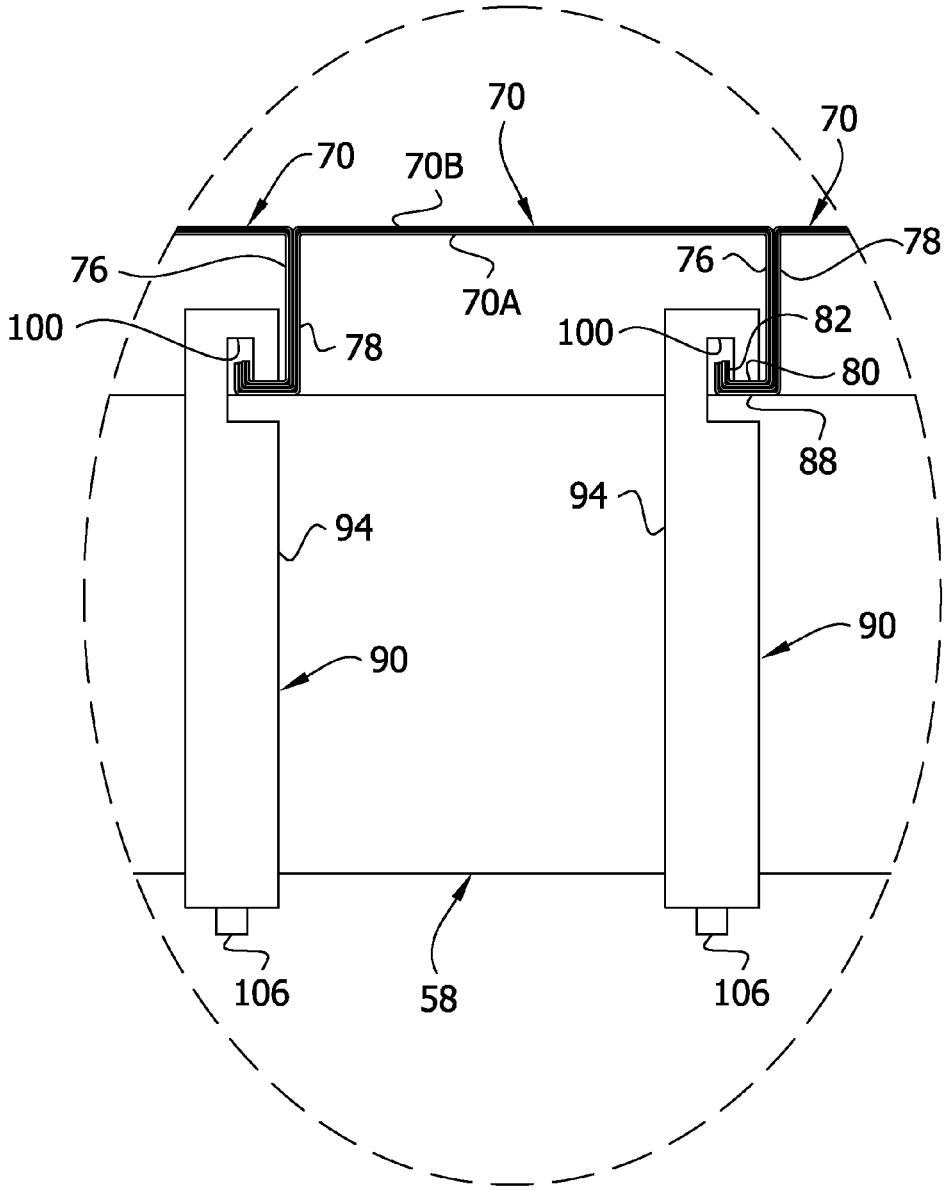
FIG. 5 is an enlarged portion of FIG. 2 showing details of bulkhead panels clamped to a girder.

FIG. 5 shows three panels 70 positioned in vertical side-by-side relation with the side flanges 78 along one (left) side of each panel generally adjacent the side flanges 76 along an adjacent (right) side of the adjacent panel. As thus positioned, the out-turned flange portions 88 and lips 90 of the upper and lower panel members 70A, 70B of each panel 70 overlap the in-turned flange portions 80 and lips 82 of the upper and lower panel members of the adjacent panel. Any number of panels may be assembled in this way to form the stopping across the mine passageway.

Figure 7:
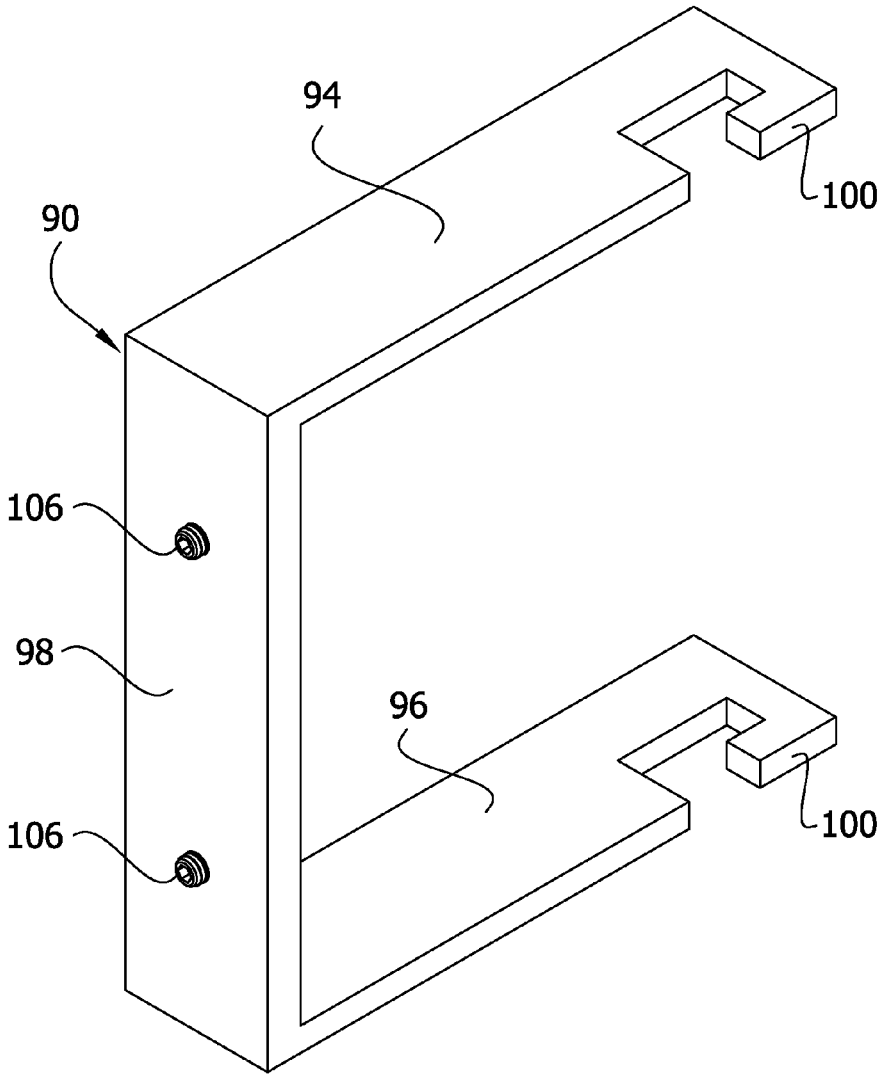
FIG. 7 is an enlarged portion of FIG. 1 showing a clamp for clamping panels to girders.

The panels 70 are secured to the horizontal girders 58 by clamps 90. As shown best in FIGS. 5 and 7, each clamp 90 is generally U-shaped and defines a recess that receives a girder. The clamp 90 is made of a continuous strap of metal such as steel formed to have an upper arm 94 extending generally horizontally over the girder 58, a lower arm 96 extending generally horizontally under the girder, and a vertical web 98 connecting the two arms. The arms 94, 96 have hooks 100 at their outer ends for hooking onto the overlapping flanges 76, 78 of respective panels 70. The vertical web 98 has at least one screw hole 104 (two are illustrated in FIG. 7) offset from the vertical center of the web. A set screw 106 is received in each hole to secure the clamp to the girder.

The design of the clamps 90 is advantageous in several respects. First, the clamps are sufficiently strong to withstand the concussive negative pressure peaks during an explosive blast tending to pull the panels 70 forward away from the girders 58. In this regard, the hooks 100 are sufficiently strong to resist substantial deformation and remain hooked when substantial negative pressure is applied to the panels 70. Further, the clamps 90 allow the panels 70 to yield upon convergence between the roof 44 and the floor 46 by permitting the upper and lower panel members 70A, 70B to telescope into one another to accommodate the reduced entry height, and without causing buckling or other damage to the panels 70.

The vertical joints 110 between the panel members 70A, 70B (FIG. 3) are sealed by applying a suitable sealant, such as silicone caulk or slow-setting polyurethane foam, along the overlapping flanges 76, 78 of the extended panel members 70A, 70B, as will be described in further detail later. Transverse joints 114 (FIG. 3) between the panel members 70A, 70B of the panels 70 can be sealed similarly after the panels are fully extended and locked in place, as will also be described later. The perimeter regions of the panels 70 are sealed using a suitable sealant on both sides.

Figure 8:
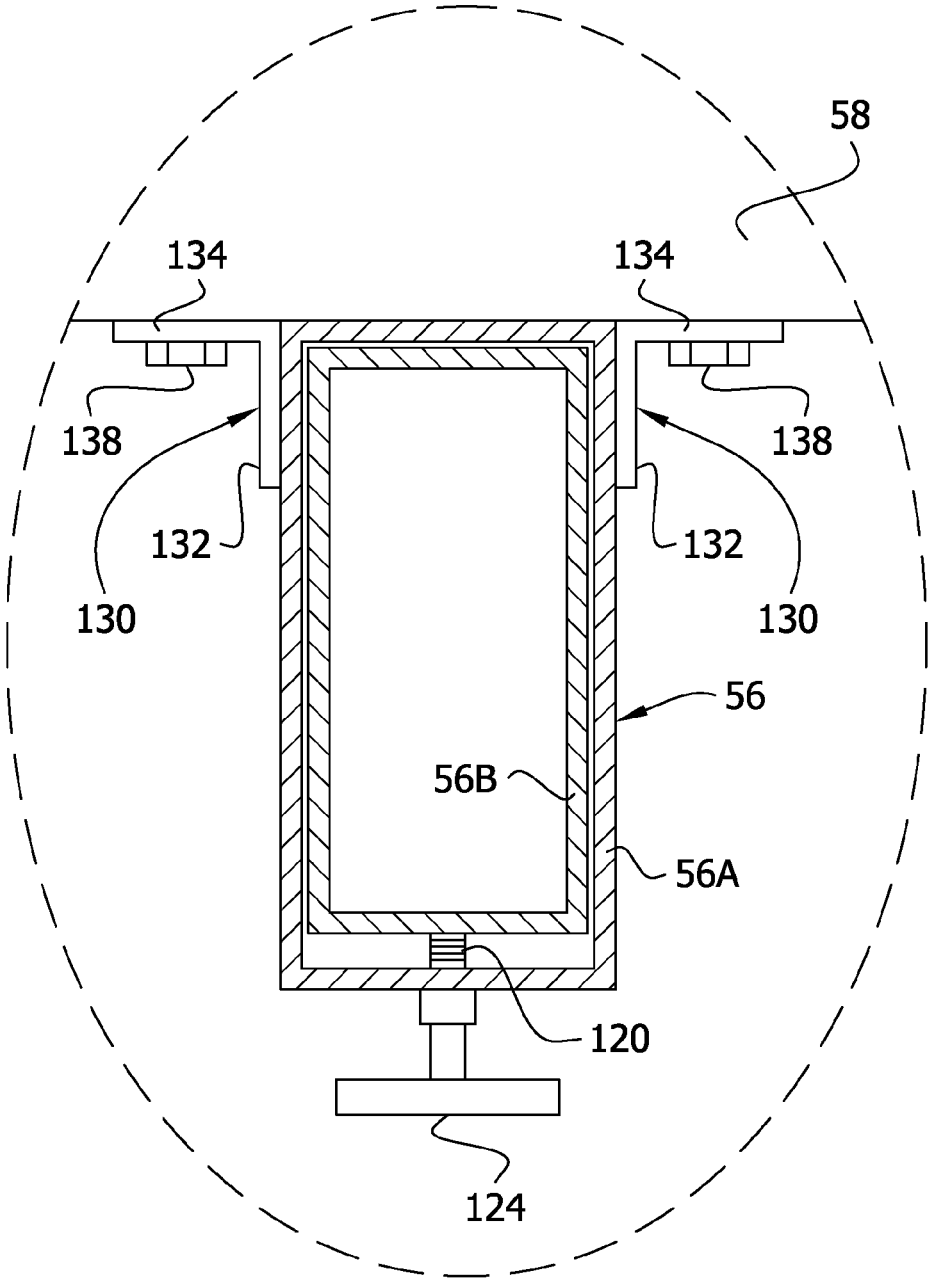
FIG. 8 is a sectional view showing attachment of a girder to a column.

Desirably, the columns 56 are telescopic and yielding to accommodate convergence between the roof 44 and floor 46, and in order to cover a wide installation height range. As shown in FIGS. 1 and 8, each column 56 has an outer (lower as illustrated) section 56A and an inner (upper) section 56B telescopically received in the outer section. Desirably, the sections 56A, 56B are generally rectangular in transverse cross section, although this shape may vary. The upper and lower ends of the column 56 are connected to the roof and floor of the room by roof and floor anchor units 66, respectively. Set screws 120 threaded through the outer section 56A of each column 56 into friction engagement with the inner section 56B hold the inner and outer column sections in the proper telescoping relation relative to one another while allowing the two sections to slide relative to one another in the event of a roof-floor convergence. Desirably, the set screws have T-handles 124 to facilitate use. The amount of overlap between the column sections 56A, 56B is dictated by the reasonable spacing of the set screws 120 that provide the convergence resistance, and the length of outer section 56A available for "storage" in the completely collapsed column. In the case of a column 56 having a length in the 4-7' range, the inner section 56B may be approximately 4' long, leaving a minimum of 12" of inner section still telescoped at full extension. The upper and lower ends of each column 56 are connected to the mine strata by the high-strength anchor units 66, as will be described.

L-shaped girder brackets 130 are attached to opposite sides of each of the outer column sections 56A (FIG. 8). Each bracket 130 has a first leg 132 affixed (e.g., welded) to a respective side wall of the column section and a second leg 134 protruding laterally from the side wall. The protruding legs 134 of the brackets 130 have fastener openings for receiving fasteners 138 (e.g., bolts) to attach a girder 58 to the columns 56, as will be described later.

Figure 27:
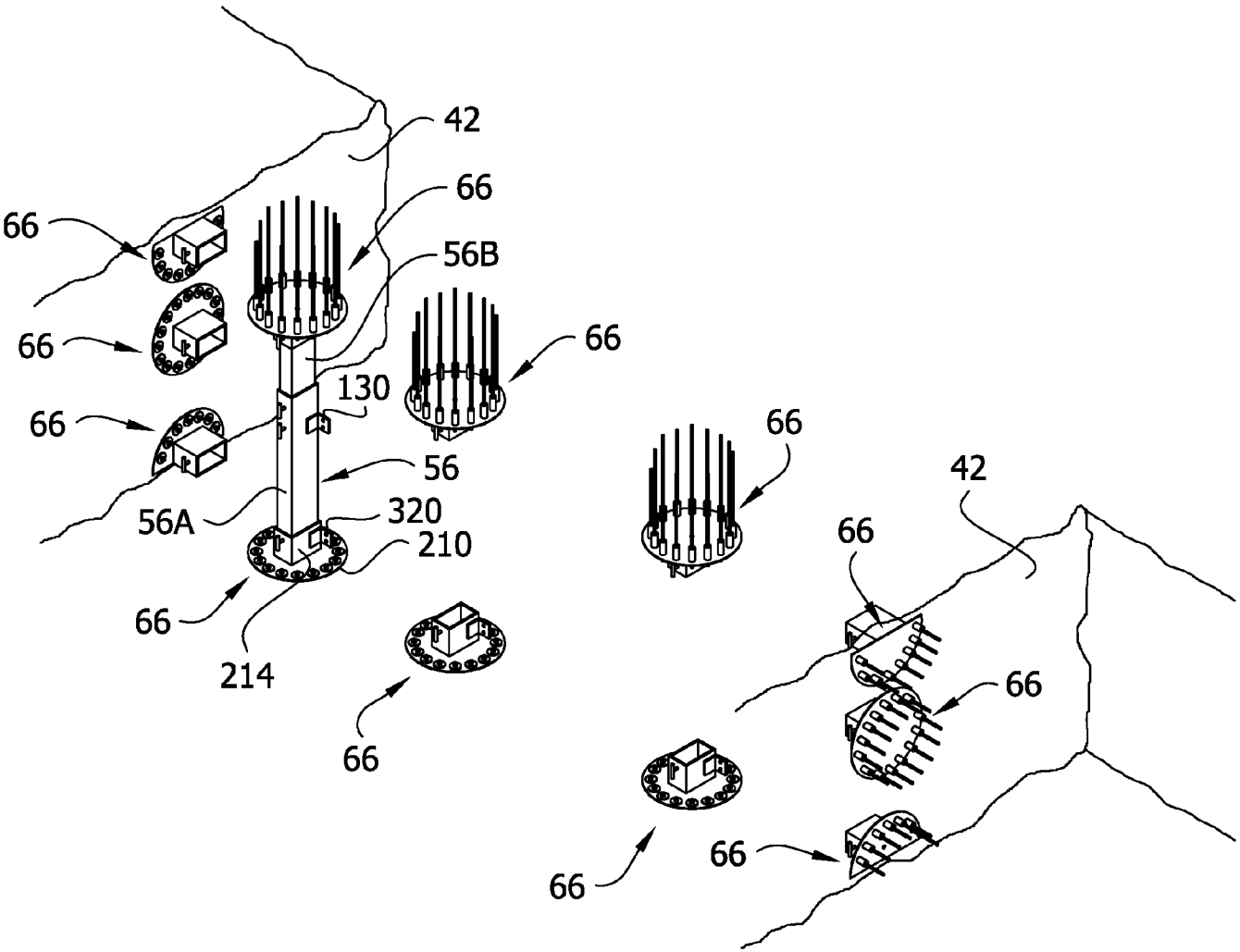

The girders 58 take concussive force from the panels 70 and transfer it to the mine strata at opposite sides 42 of the room and to the columns 56. As best illustrated in FIG. 27, each girder 58 comprises a plurality of telescoping sections allowing for length adjustment and for pillar convergence (i.e., shifting of opposing side walls 42 toward one another). In the illustrated embodiment, the girder 58 comprises an outer center section 58A and pair of inner end sections 58B telescoped into opposite ends of the center section. Desirably, the sections 58A, 58B are generally rectangular in transverse cross section, although this shape may vary. Set screws 140 threaded through the outer center section 58A of each girder 58 into friction engagement with the inner end sections 58B hold the inner and outer girder sections in the proper telescoping relation relative to one another while allowing the sections to move relative to one another in the event of a rib convergence (i.e., pillar expansion). The set screws have T-handles 142 to facilitate use. The amount of overlap between the girder sections 58A, 58B is dictated by the reasonable spacing of the set screws 140 that provide the pillar expansion resistance, and the length of outer center section 58A available for "storage" in the completely collapsed girder. In the case of a girder 58 having a length in the 18-23' range, the inner end sections 58B may be approximately 5' long, leaving a minimum of 2.5' of each inner section still telescoped in the outer center section 58A at full extension. The end sections 58B of each girder are connected to the mine strata by high-strength anchor units 66, as will be described.

Referring to FIG. 2, a door unit 150 in the wall structure 54 provides access to and from the safe room 40. In the illustrated embodiment, the door unit 150 comprises an air lock tunnel 154 installed in an opening in the panels 70 to extend into the safe room 40, and outer and inner doors 156, 158 closing respective outer and inner ends of the tunnel. The tunnel 154 is rectangular in vertical cross section. Other shapes are possible.

Figure 9:
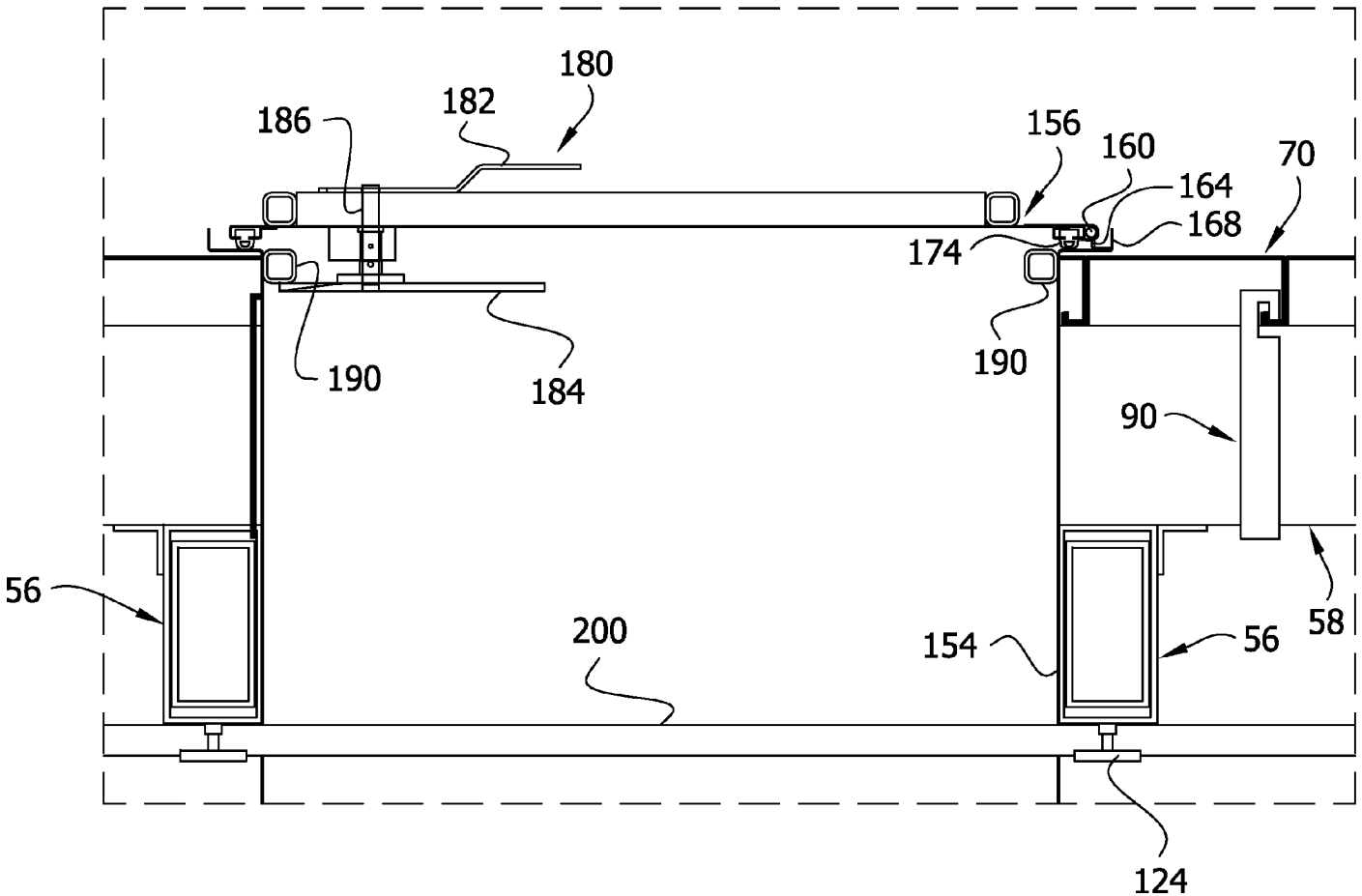
FIG. 9 is an enlarged portion of FIG. 2 showing details of a door unit of the bulkhead.

The outer door 156 is hinged at 160 to a frame 164 secured to a peripheral flange 168 at the outer end of the tunnel 154, as shown in FIG. 9. A seal 174 on the inner face of the door seals against the peripheral flange 168 around the tunnel opening when the door is swung to its closed position. The peripheral flange 168 of the tunnel 154 and the frame 164 overlie the panels 70 adjacent the perimeter of the door so that when the seal 174 is fully compressed, the panels 70 and girders 56 to which they are clamped take the pressure loads exerted on the outer door 156 generated by an explosion outside the safe room 40. The pressure on the flange 168 is continuous around the door 156.

The door is provided with a suitable latching device 180 for holding the door closed (see FIG. 2). The latching device 180 comprises an outer latching bar 182, an inner latching bar 184, and a shaft 186 through the door 156 mounting the two latching bars for rotational movement relative to the door. When the latching device 180 is rotated to its locking position, as shown in FIG. 9, the inner latching bar 184 moves behind a keeper 190 secured to an inside wall of the tunnel 154 to latch the door 156 closed. The outer door 156 has a viewing window 194 (FIG. 3) and may be equipped with suitable pressure relief valves configured to open to relieve any excess pressures inside the safe room. Desirably, the outer door 156 is reinforced with suitable stiffening ribs, bars, and/or flanges to withstand concussive blast forces.

The inner door 158 has substantially the same construction as the outer door 156, although it may not be reinforced.

Metal stiffening bars 200 are attached (e.g., welded) to the top and bottom sides of tunnel 154. The bars 200 extend across the tunnel 154 and are attached by suitable means to the two columns 56 immediately adjacent opposite sides of the tunnel. These bars 200 restrain the door unit 150 against movement in an outward direction due, for example, to the negative pressure induced load from the rarified portion of the concussive wave generated during an explosion in the mine.

The door unit 150 may have other configurations. By way of example but not limitation, the door unit may comprise only an outer door with no tunnel or inner door. Further, the door unit may have the configuration of the doors described in co-assigned U.S. Pat. Nos. 6,032,986 and 7,393,025, both of which are incorporated herein by reference.

FIGS. 1 and 10-13 illustrate an anchor unit 66 of the high-strength connection system. The unit 66 comprises an anchor plate 210 adapted to be secured to the mine strata and a connecting member 214 on the anchor plate to which one of the bulkhead supports (column 56 or girder 58) can be connected. The anchor plate 210 has an outer face 218 that faces toward the outside of the safe room 40 when the anchor unit is installed, an inner face 220 that faces toward the inside of the safe room when the anchor unit is installed, and a peripheral edge 224. The plate 210 is depicted as circular, but it may have other shapes (e.g., rectangular). By way of example, the anchor plates 210 of the anchor units 66 to be placed at the roof 44 and floor 46 of the mine may be truncated along a chord of the otherwise circular plate (see FIG. 1) to allow the girders 58 to be positioned with the chord edge of the plate against the roof/floor. The chord edge extends generally parallel to one side of the connecting member 214.

The connecting member 214 is a socket member (also designated 214) sized for receiving an end of one of the bulkhead supports (girder 56 or column 58). In the illustrated embodiment, the socket member 214 is formed by a rectangular structural tube, but other configurations are possible. The socket member 214 is rigidly attached to a center region 230 of the anchor plate, as by welding. One or more T-handle set screws 234 are threaded through a wall of the socket member 214 for friction engagement with a support received in the socket member (girder 58 in FIG. 11) to hold the support fixed in the socket member. Desirably, the socket member 214 is sized for a close clearance fit of the girder or column in the socket member.

The anchor plate 210 has a plurality of anchor bolt holes 240 (FIG. 14) spaced at intervals around the plate in an outer peripheral region 242 of the plate between the connecting member 214 and the peripheral edge 224 of the plate. The number of anchor bolt holes 240 may vary (sixteen being shown). However, for most applications, at least four and preferably eight or more bolt holes should be provided spaced at substantially equal intervals around the plate 210 adjacent the peripheral edge 214 of the plate.

Figure 10:
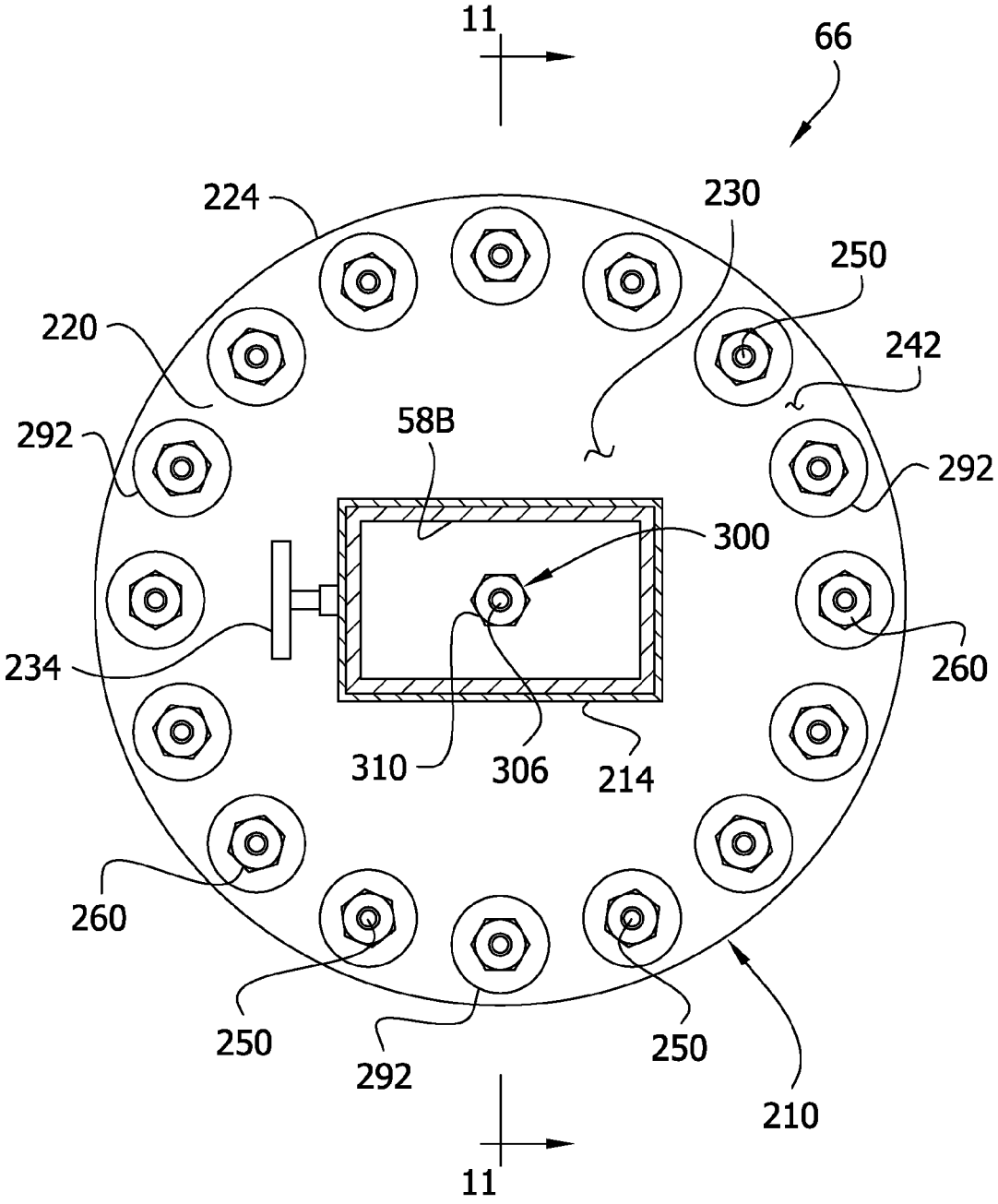
FIG. 10 is an enlarged vertical section taken in the plane of line 10-10 of FIG. 1.
Figure 11:
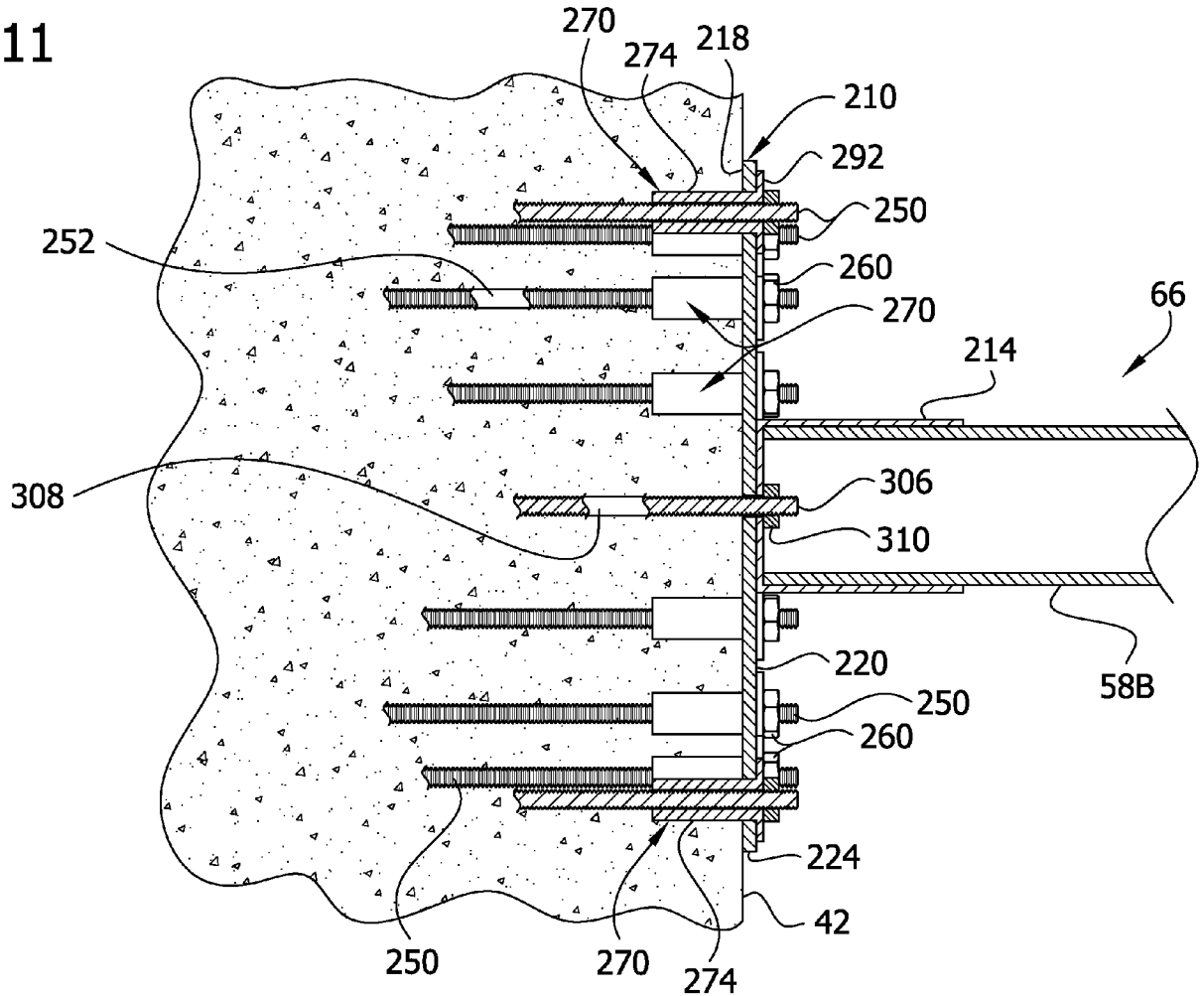
FIG. 11 is a vertical section taken in the plane of line 11-11 of FIG. 10 showing anchor bolts securing an anchor unit of the anchor system to mine strata.
Figure 12:
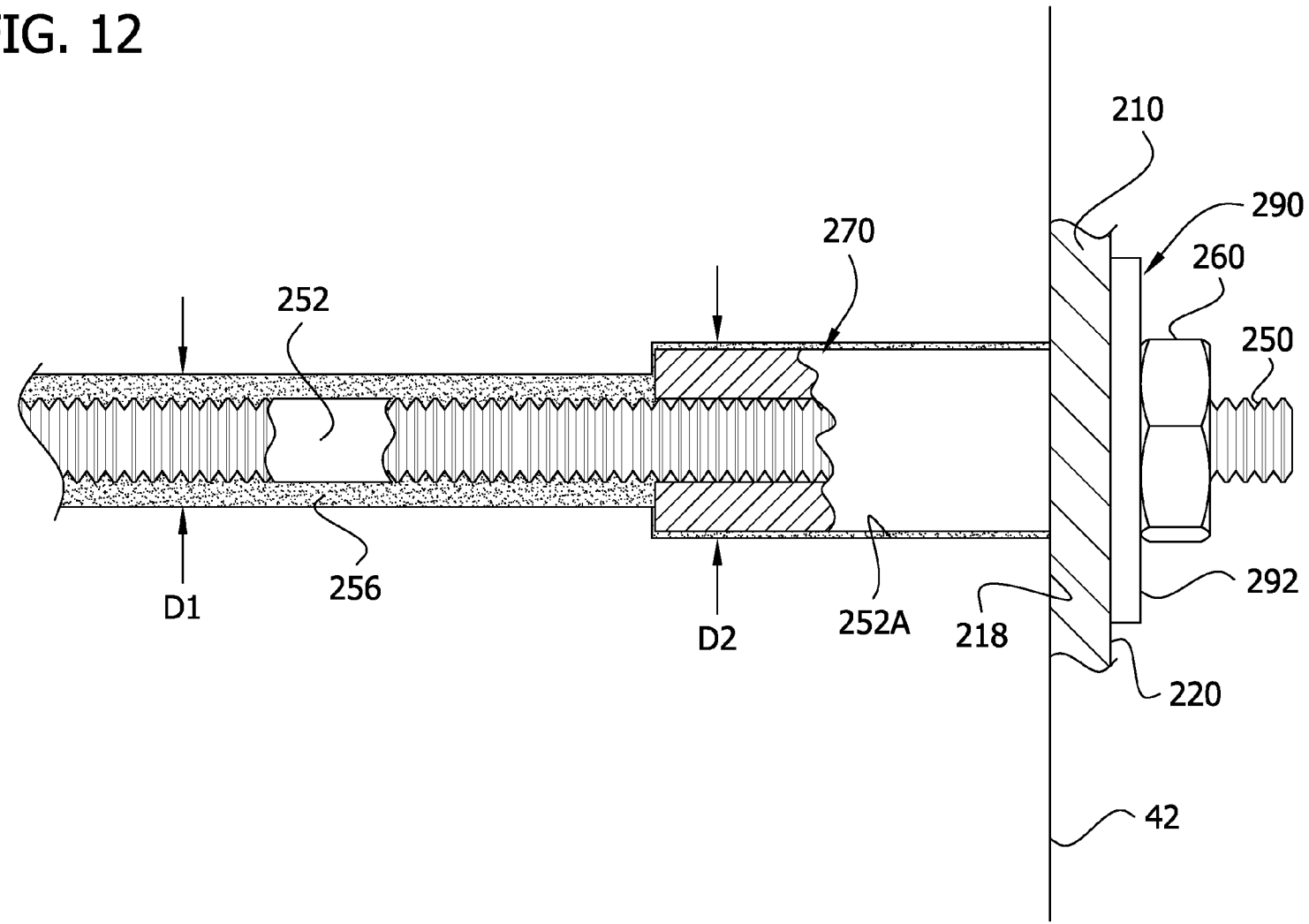
FIG. 12 is an enlarged portion of FIG. 9 showing details of how an anchor bolt secures the anchor unit to the mine strata.

The anchor plate 210 is secured to the mine strata (e.g., floor, roof, or sides of the safety room 40) by anchor bolts 250 extending through the anchor bolt holes 240 into anchor bore holes 252 drilled in the mine strata (see FIGS. 10-12). The anchor bolts 250 are fixed in respective bore holes 252 by a suitable anchoring grout 256 (FIG. 12), as will be understood by those skilled in the mining field. Fasteners 260 (e.g., nuts) threaded on the anchor bolts 250 secure the anchor plate 210 to the anchor bolts. Desirably, the anchor bolts 250 are covered by ASTM F432-04, Standard Specification for Roof and Rock Bolts and Accessories. Standard rock (roof) bolts are #5 rebar with either a head or threads on the end protruding from the mine face and either threads with an expansion shell or just a plain, deformed, rebar the whole length to the opposite end. If there is an expansion shell it can be used either by itself or in conjunction with grout. If it is just a plain deformed re-bar, grout 56 holds it in place. In either case, a typical anchor bolt 250 has a diameter of ⅝" and the bore hole 252 for receiving it has a typical diameter of 1⅜" (represented as D1 in FIG. 12) so that the bolt fits loosely in the bore hole. The annular space around the bolt 250 is filled with grout 256 in a conventional manner to secure the bolt in the bore hole.

Figure 13:
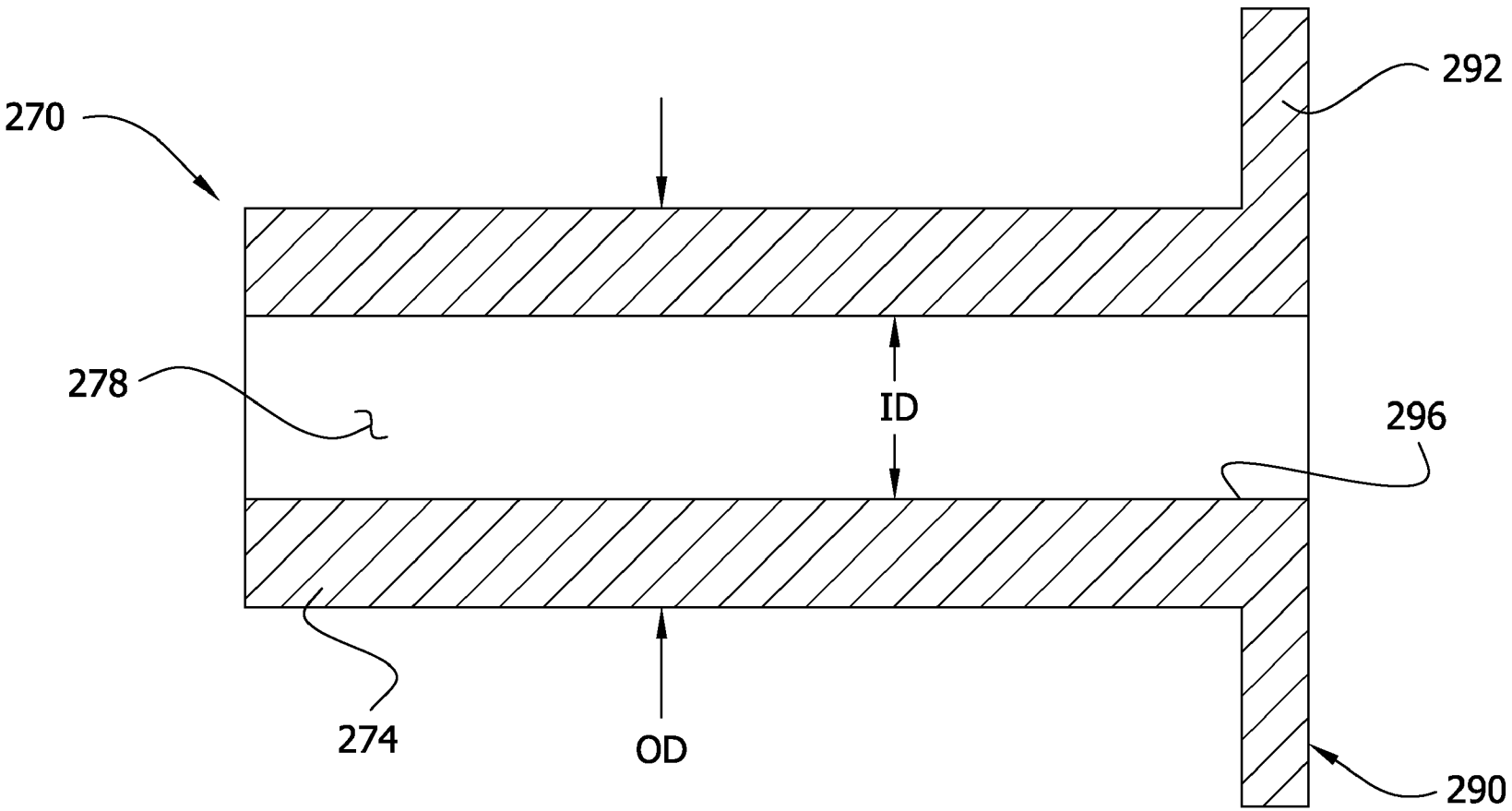
FIG. 13 is a sectional view of one embodiment of a load-spreading and centering device of the anchor unit.

Referring to FIGS. 11, 12, and 13, the anchor unit 66 includes devices 270 for spreading large shear loads exerted on the anchor bolts 250 by explosive forces, for example, over larger areas of the mine strata. As best illustrated in FIG. 13, these load-spreading devices 270 extend from respective bolt holes 240 in the anchor plate 210 into respective bore holes 252 in the mine strata, the entry ends 252A of which may be enlarged to receive the devices. (FIG. 12 illustrates an enlarged entry end as having a diameter of D2 compared to the conventional bore hole diameter D1.) In the illustrated embodiment, each load-spreading device 270 comprises a sleeve 274 positioned in a respective anchor bolt hole 240 in the plate (FIGS. 12-16). The sleeve 274 has an inside surface defining a sleeve opening 278 generally co-axial with the anchor bolt hole 240. The sleeve opening 278 has an inside diameter ID sized for close clearance reception of a respective anchor bolt 250. The sleeve 274 has an outside surface having an outside diameter OD greater than the inside diameter ID (e.g., at least 0.5" greater). Desirably, the outside surface of the sleeve 274 has a cylindrical shape corresponding to the shape of the bore hole 252, and the outside diameter of the sleeve is only slightly less than the diameter D2 of the bore hole section 252A (which may be enlarged, as mentioned) so that the sleeve has a close friction fit in the hole. Desirably, the sleeve 274 is sized to spread the shear forces exerted on the bolt 250A over a substantially greater area than would otherwise be the case. By way of example, if the anchor bolt 250 is a ⅝" diameter bolt, the sleeve 274 may have an ID of ¾", an OD in the range of 1⅜" to 2½" (e.g., about 1½"), and a length L in the range of 2" to 6" (e.g., about 3"). The anchor bolt hole 240 has a diameter slightly larger than the outside diameter of the sleeve 274 (e.g., 1 9/16" compared to 1½"). Other dimensions are possible. For example, if more shear resistance is desired, the diameters of anchor bolts 250 and outside diameters of the sleeves 274 can be increased. Alternatively, these dimensions can be reduced if a less shear resistance is acceptable. Similarly, if the mine strata is particularly weak, the length L of the sleeve 274 can be increased.

In the illustrated embodiment, the sleeve 274 is formed as a part separate from the anchor bolt 250. Alternatively, the sleeve 274 may be formed as an integral part of the bolt 250, such that the bolt has a section of increased diameter D2 along a length of the bolt corresponding to the length of the sleeve 274.

The anchor unit 66 also includes centering devices 290 for holding the anchor bolts 250 centered in their respective bolt holes 240 and bore holes 252 prior to and during the grouting process. As a result, loads are transferred more efficiently through the grout 256 which, when hard, is stronger than the surrounding mine strata. Each centering device 290 comprises an annular flange 292 on the anchor plate 210 defining a flange opening 296 that is generally co-axial with a respective anchor bolt hole 240 and sized for close clearance reception of a respective anchor bolt 250 to hold the bolt centered relative to the bolt hole 240 and bore hole 252. In the illustrated embodiment, the flange 292 is on the inside face 220 of the anchor plate and is integrally joined to the sleeve 274 to form what may be referred to as a "bushing." Alternatively, the flange 292 may be a separate piece having a removable connection with the sleeve 274, or it may be a separate piece affixed to the anchor plate 210 but not to the sleeve. Other centering devices may be used without departing from the scope of this invention.

The anchor unit 66 further comprises a locating device 300 for temporarily holding the anchor plate 210 in a selected position on the mine strata prior to and during drilling of at least the first anchor bolt hole 252, as will be described later. In the illustrated embodiment, this locating device 300 comprises a center bolt hole 302 in the center region 230 of the anchor plate 210 for receiving a center bolt 306 extending into a center bore hole 308 drilled in the mine strata. A fastener 310 threads on the bolt 306 to temporarily hold the anchor plate 210 in a selected position on the mine strata until the first anchor bolt bore hole 252 is drilled. Other locating devices can be used.

Figure 14:
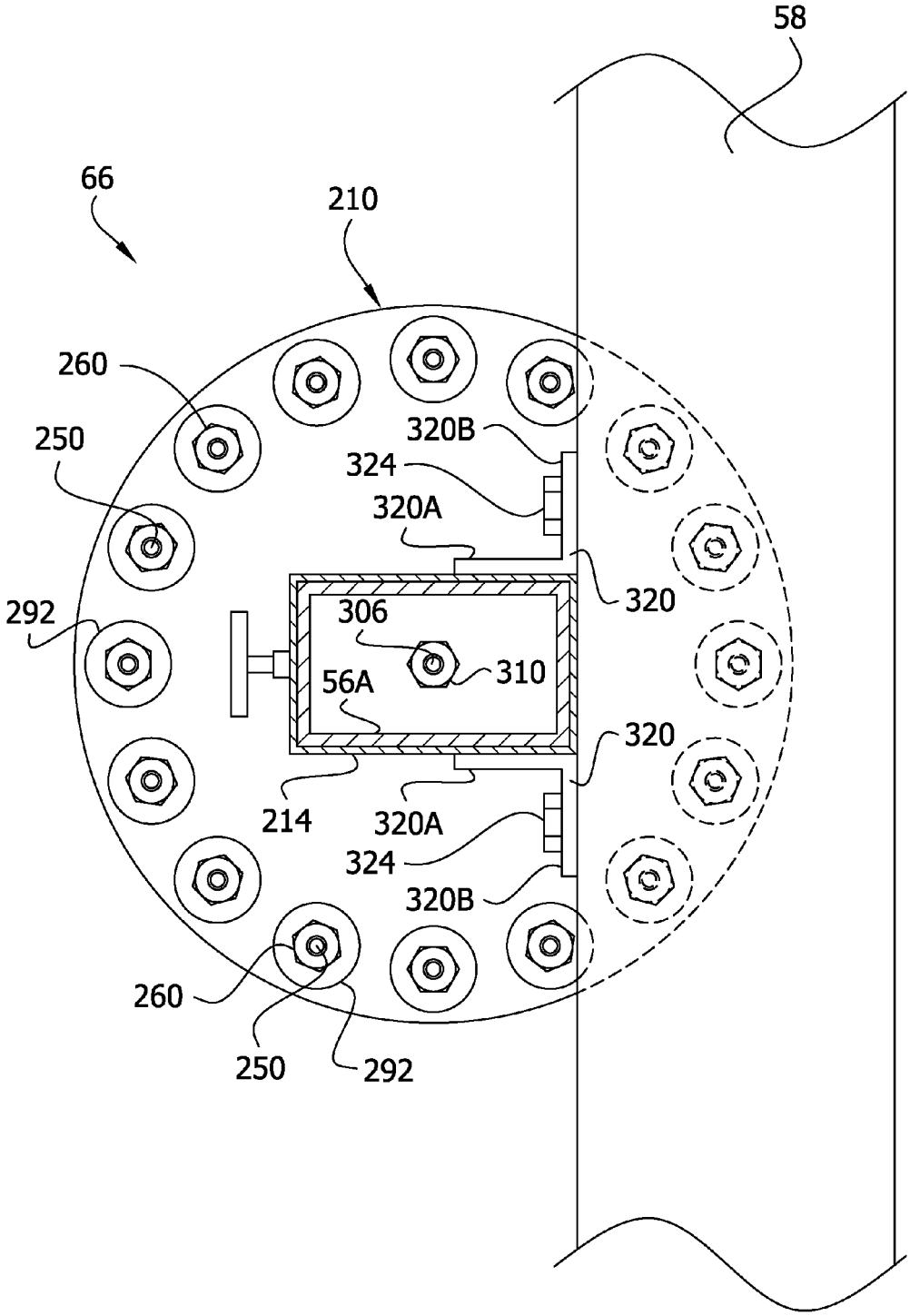
FIG. 14 is a sectional view showing attachment of a girder to a roof or floor anchor unit.
Figure 15:
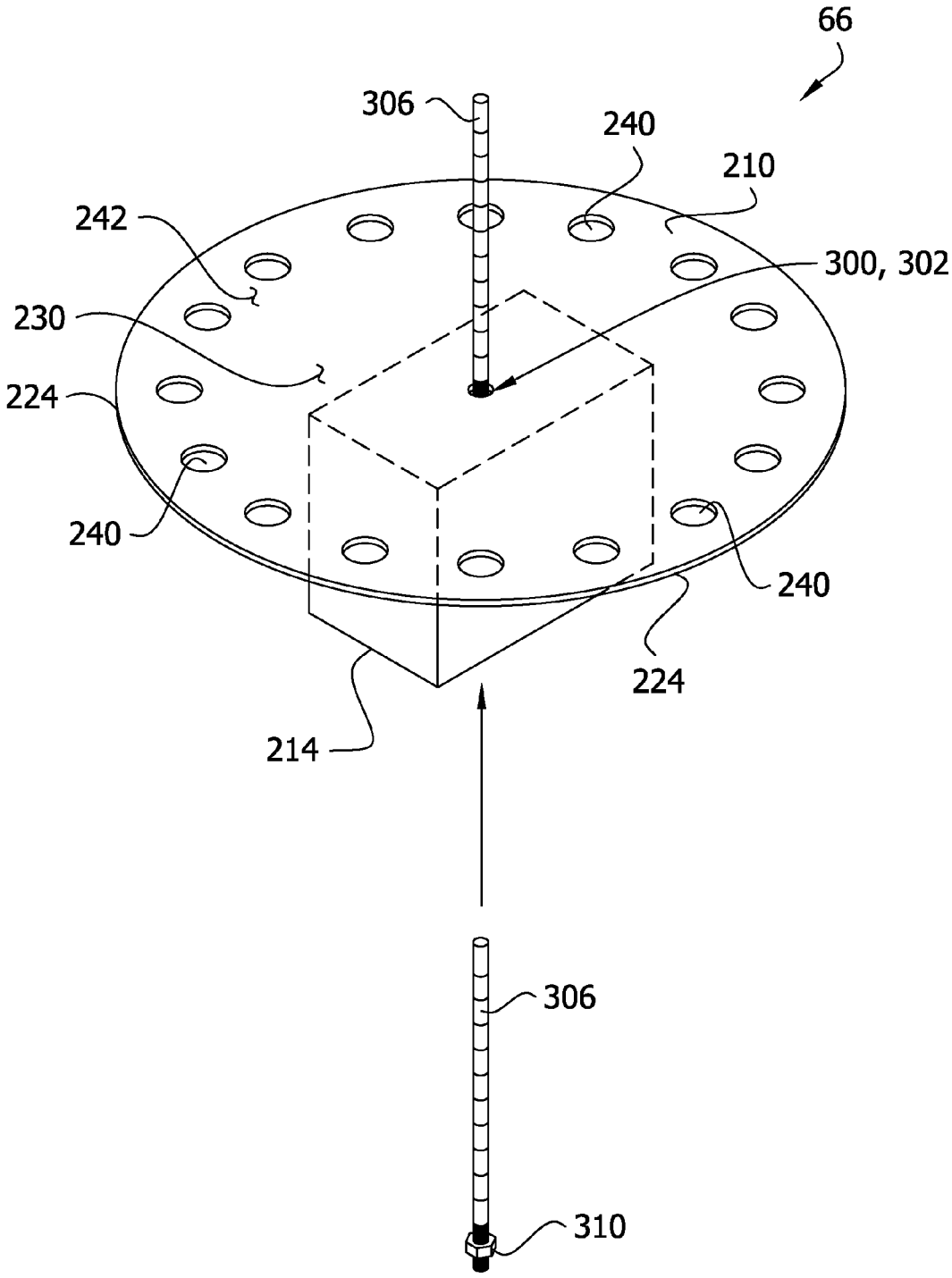
FIGS. 15-18 are views illustrating an exemplary sequence of steps for anchoring an anchor unit to the mine strata.
Figure 16:
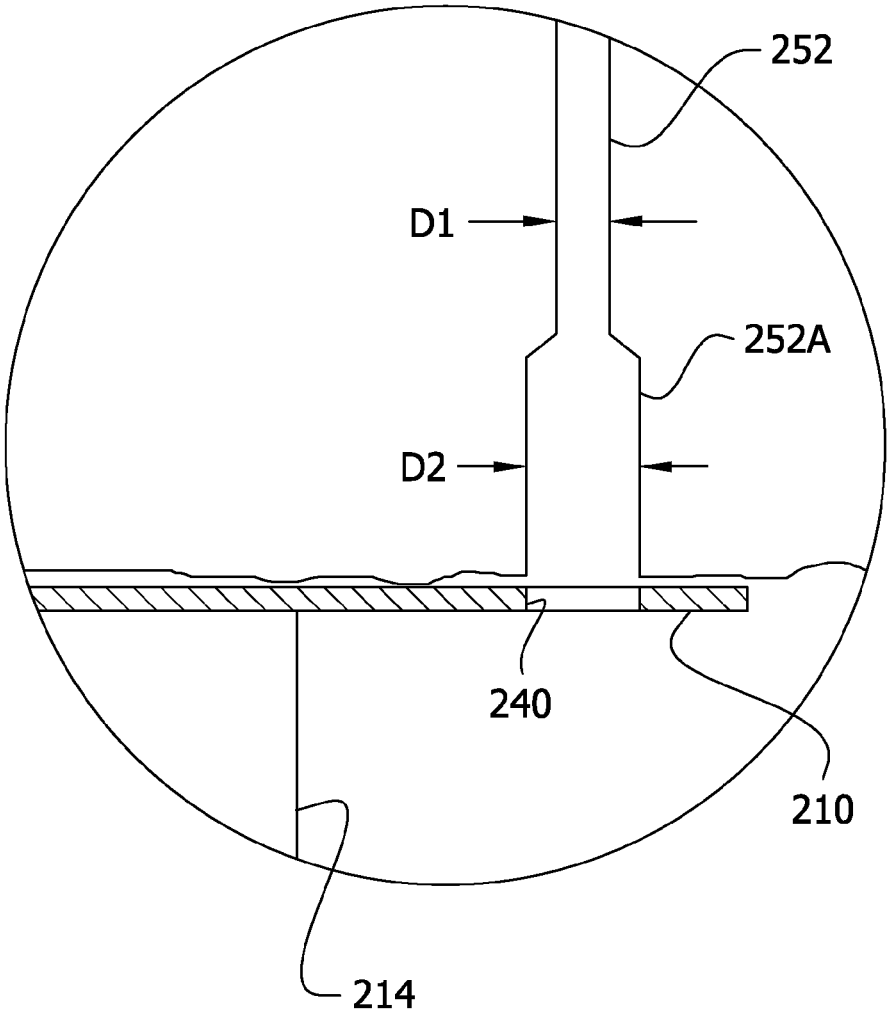

The roof and floor anchor units 66 include L-shaped girder brackets 320 for securing the top and bottom girders 58 to the units (see FIG. 14). Each anchor unit 66 includes two brackets 320 secured to opposite side walls of the socket member 214 of the unit. Each bracket 320 has a first leg 320A affixed (e.g., welded) to a respective side wall of the socket member 214 and a second leg 320B laterally protruding from the side wall. The protruding legs 320B of the brackets have fastener openings for receiving fasteners 324 to attach a girder 58 to the anchor unit, as will be described later.

Figure 17:
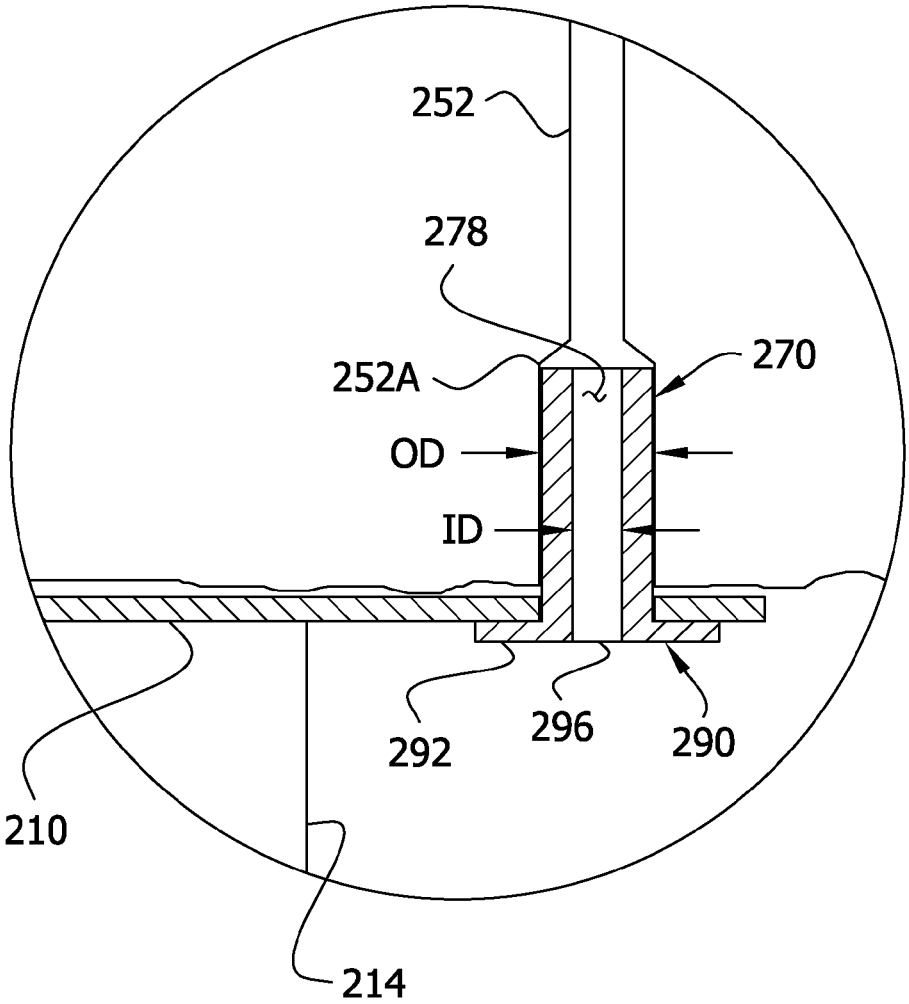
Figure 18:
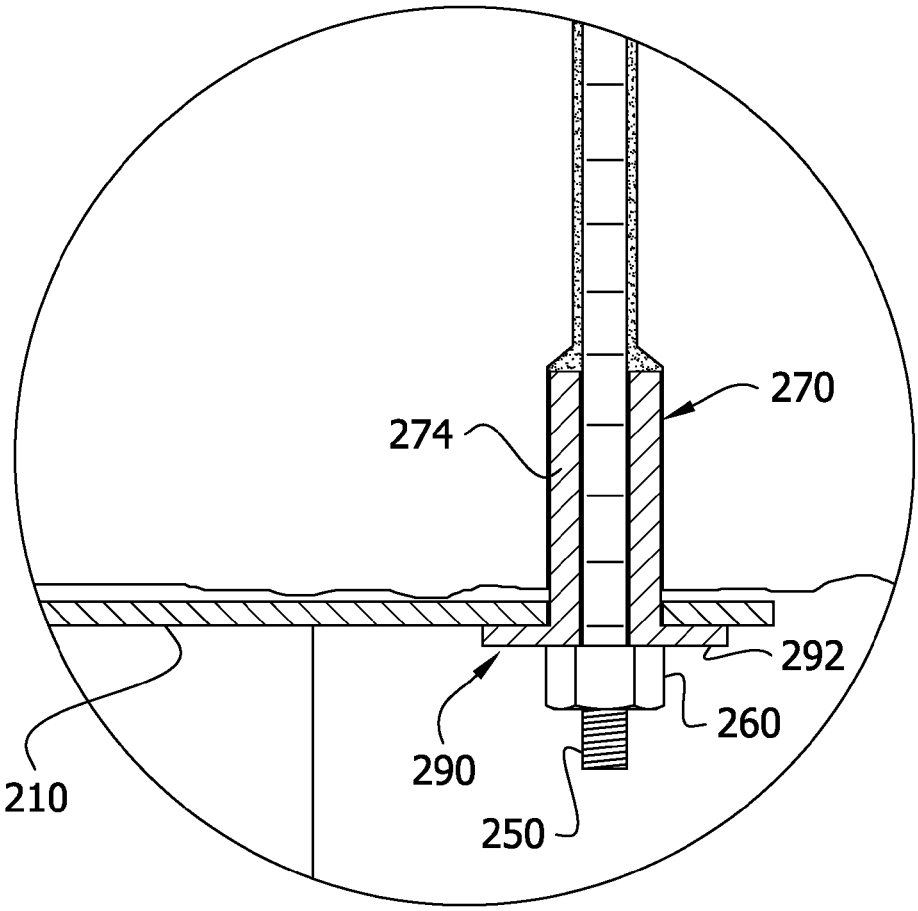
Figure 19:
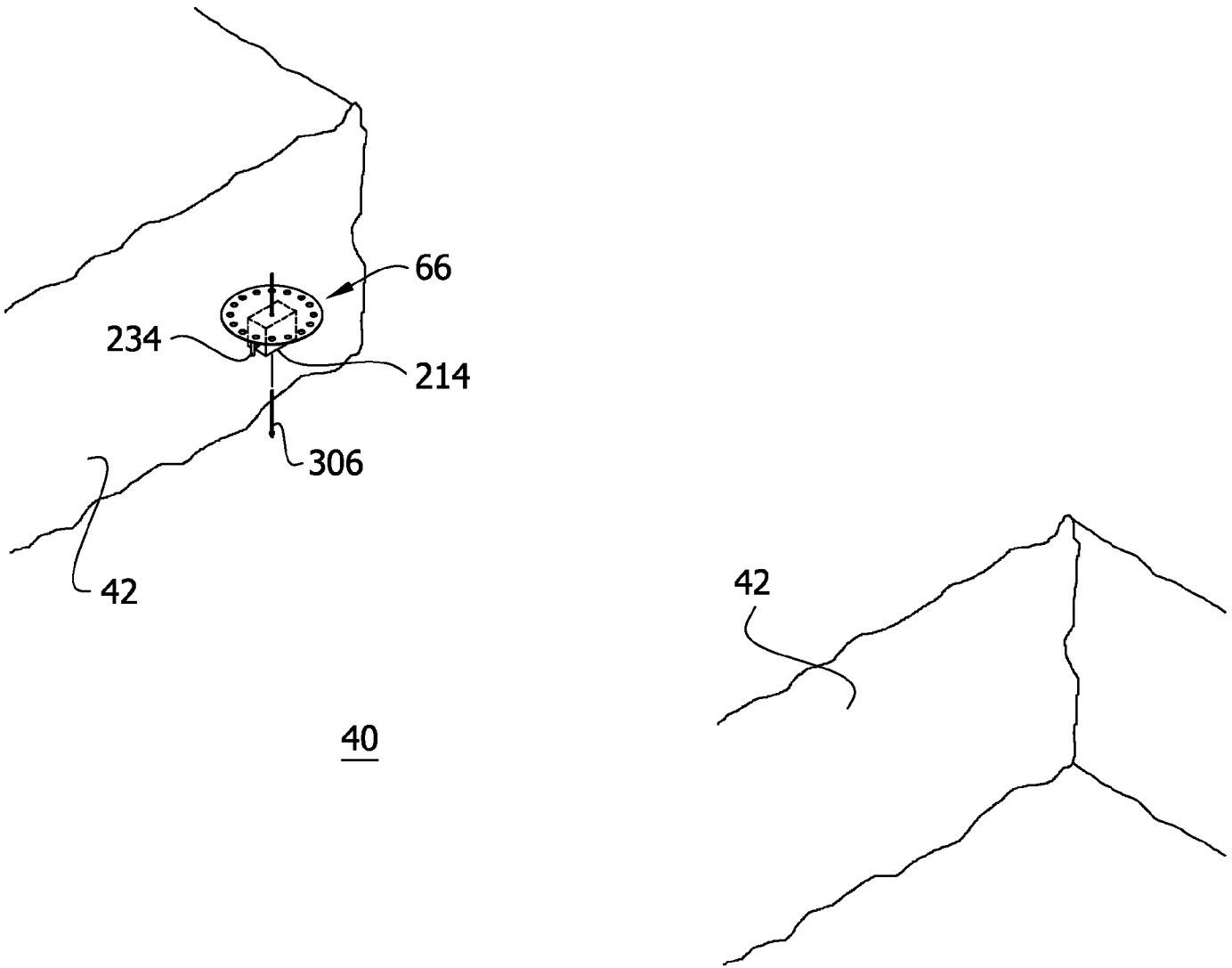
FIGS. 19-35 are views illustrating an exemplary sequence of steps for installing the bulkhead.

FIGS. 15-18 illustrate an exemplary sequence of steps for anchoring an anchor unit 66 to mine strata. In the first step (FIG. 15), the center bolt 306 is inserted through the center hole 302 in the anchor plate 210 into a center bore hole 308 drilled in the mine strata. This procedure allows the socket member 214 on the anchor plate 210 to be located and oriented as required before the anchor bolts 250 are installed. In the next step (FIG. 16), using a bolt hole 240 in the anchor plate 210 as a guide, the first bore hole 252 is drilled in the mine strata for receiving an anchor bolt 250. Desirably, the bore hole 252 has the aforementioned enlarged entry section 252A adjacent the face of the mine strata. The enlarged section 252A has an inside diameter D2 substantially equal to the outside diameter OD of the sleeve 274 of a bushing. The sleeve is inserted into a respective bolt hole 240 in the anchor plate 210 to a position in which the flange 292 is closely adjacent (and preferably in contact with) the inner face 220 of the anchor plate and the sleeve 274 extends into the enlarged section 252A of the anchor bolt bore hole 252 (FIG. 17). In the next step (FIG. 18), the anchor bolt 250 is inserted through the bolt hole 240 in the anchor plate 210 into the bore hole 252 and grouted in place. During this process, the anchor bolt 250 is held centered in the bore hole by the centering flange 292. The fastener 260 is tightened on the anchor bolt 250 to secure the anchor plate 210 to the anchor bolt after the grout has hardened (FIG. 18). Additional anchor bolts 250 and sleeve 274/flanges 292 are installed using the same procedure until the installation process is complete and the anchor plate 210 and socket member 214 are secured to the mine strata.

The high-strength anchor unit 66 provides several advantages over conventional systems. First, the anchor bolts 250 are utilized such that the full shear strength of the bolt material is available. In this regard, the anchor bolts 250 pass through the close-fitting openings 296 in the flanges 292. As a result, all of the anchor bolts 250 are placed in simultaneous shear against flanges 292 that are made of material (e.g., steel) substantially stronger than the grout 256. Second, the anchor bolts 250 are held by their respective flanges 292 in a centered position so that the load transferred in any direction by a bolt is distributed efficiently through the grout 256 and does not point load the side of its respective bore hole 252. Third, the area of the strata that receives the load is increased by the sleeves 274 of the bushings that extend into the bore holes 252.

FIGS. 19-35 illustrate an exemplary sequence of steps for installing a bulkhead 50 of this invention in a mine passage to create a safe room 40 for protecting miners in the event of a disaster.

Figure 20:
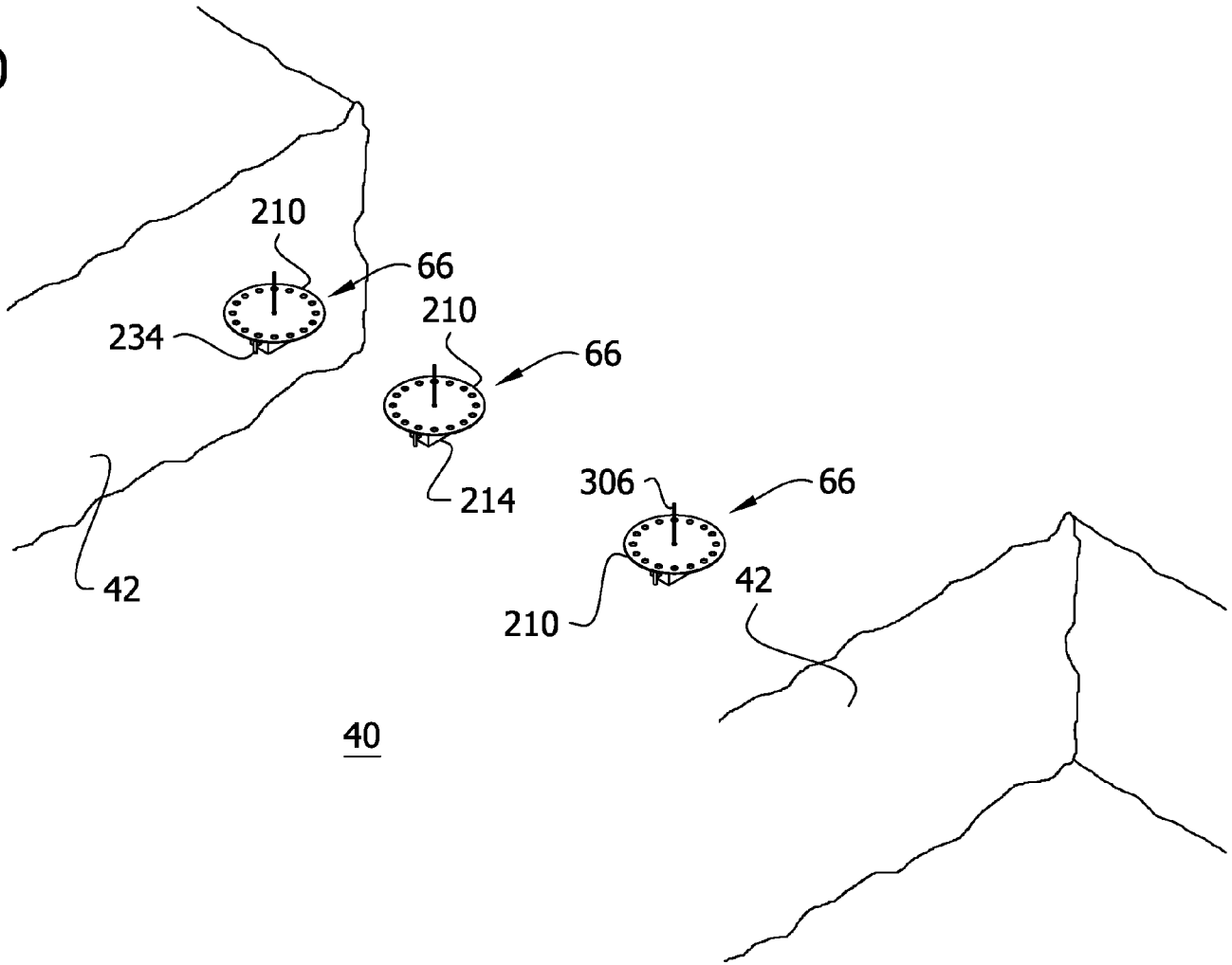

In FIG. 18, a roof anchor unit 66 is temporarily attached to the roof 44, using a center bolt 306, at a location spaced from the rib forming one side wall 42 of the room 40. The socket member 214 is preferably square with the side wall 42 and far enough back from the pillar corner (e.g., 3-9') so that the horizontal girders 58 will have sufficient support from the side walls. The socket member 214 is oriented such that the T-handle set screws 234 face toward the back of the safe room 40 and the protruding lateral legs 320B of the girder brackets 320 are positioned toward the front of the safe room. Two additional roof anchor units 66 are temporarily mounted to the roof 44 in the same manner, as illustrated in FIG. 20. The socket members 214 should be oriented in the same direction and with the front sides of the three socket members generally co-planar.

Figure 21:
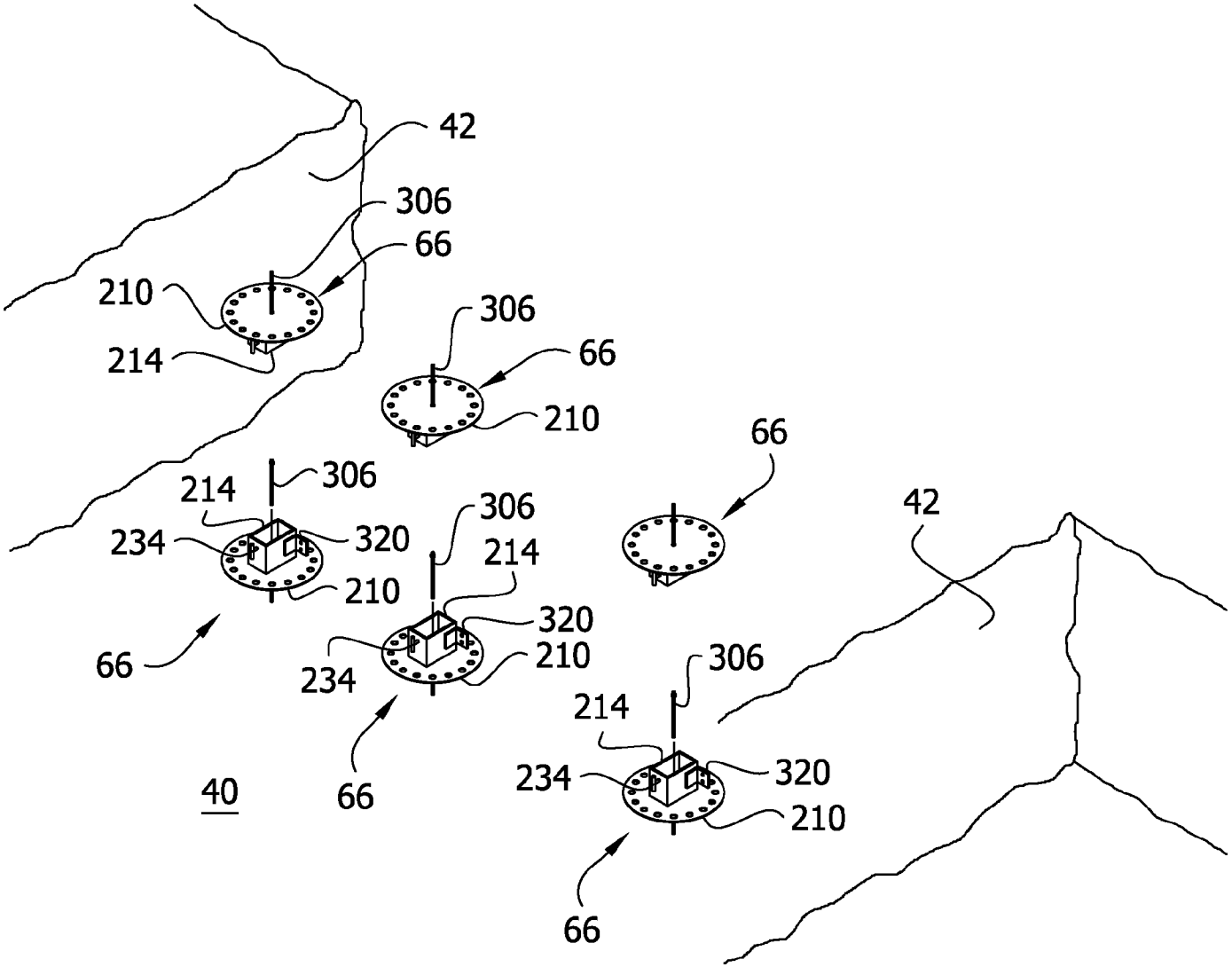

In FIG. 21 the first of three floor anchor units 66 is temporarily mounted directly and exactly below the middle roof anchor unit 66, using a bolt 306 through the center hole 302 of the anchor plate 210. Second and third floor anchor units 66 are similarly temporarily mounted directly and exactly below respective roof anchor units 66.

Figure 22:
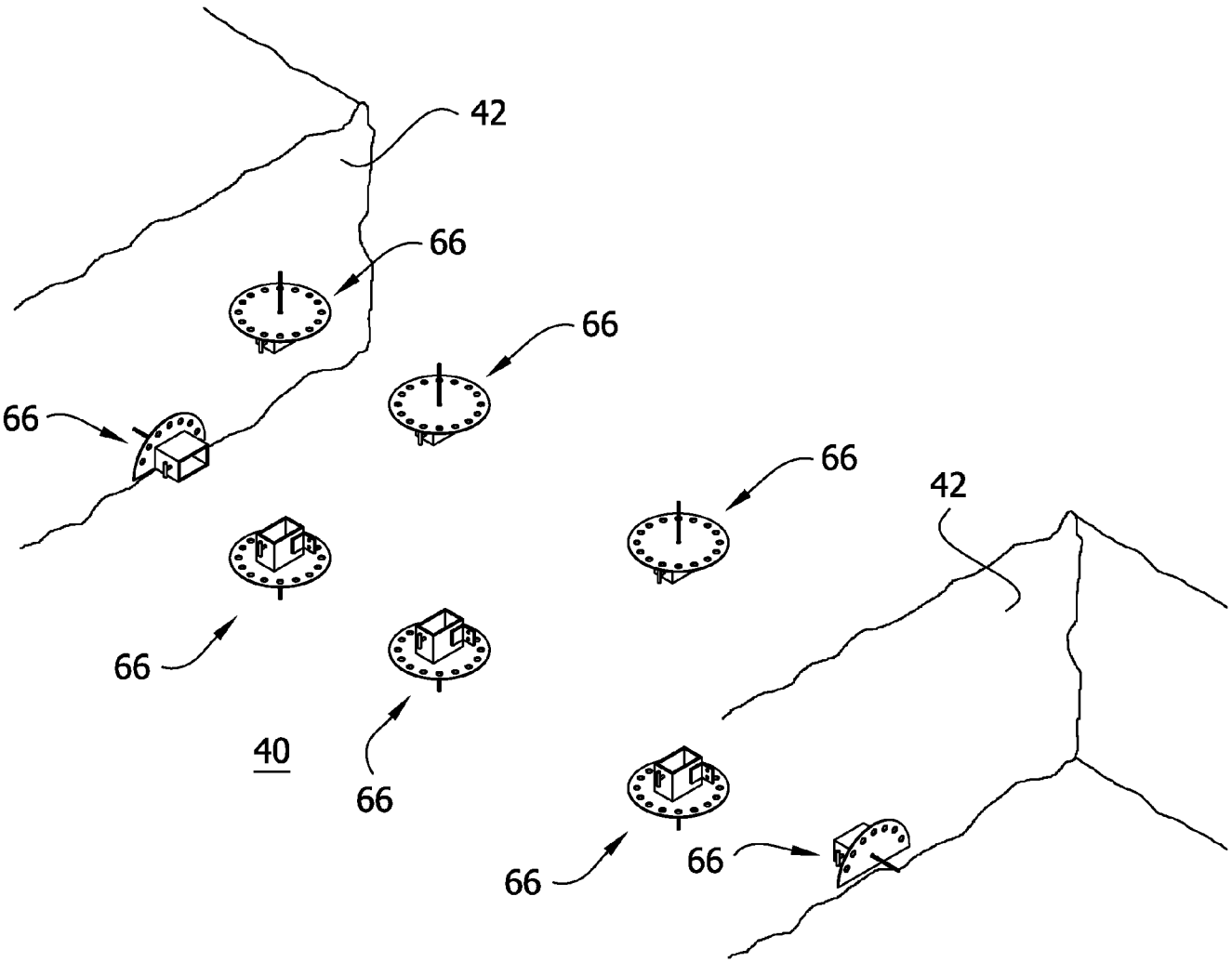
Figure 23:
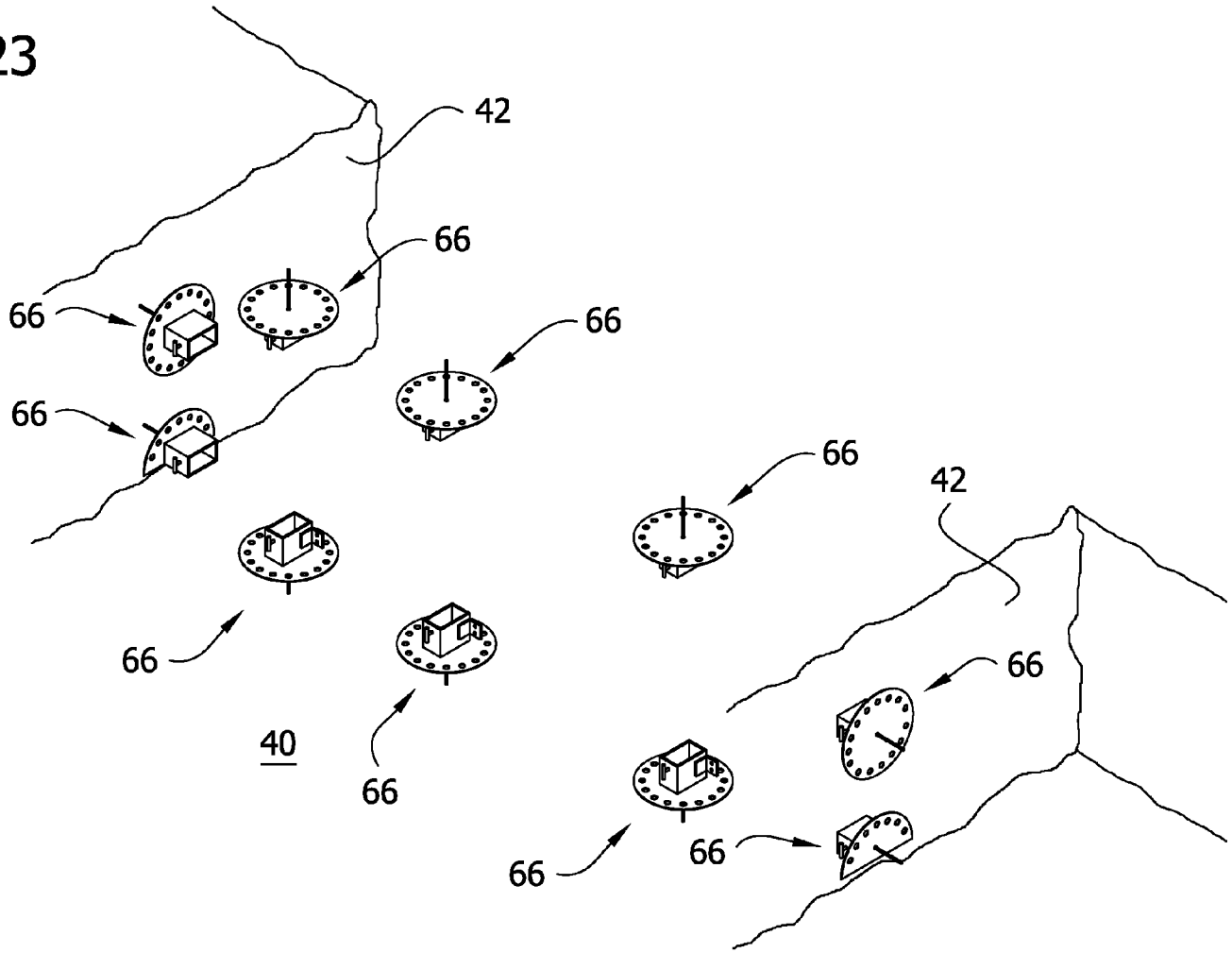
Figure 24:
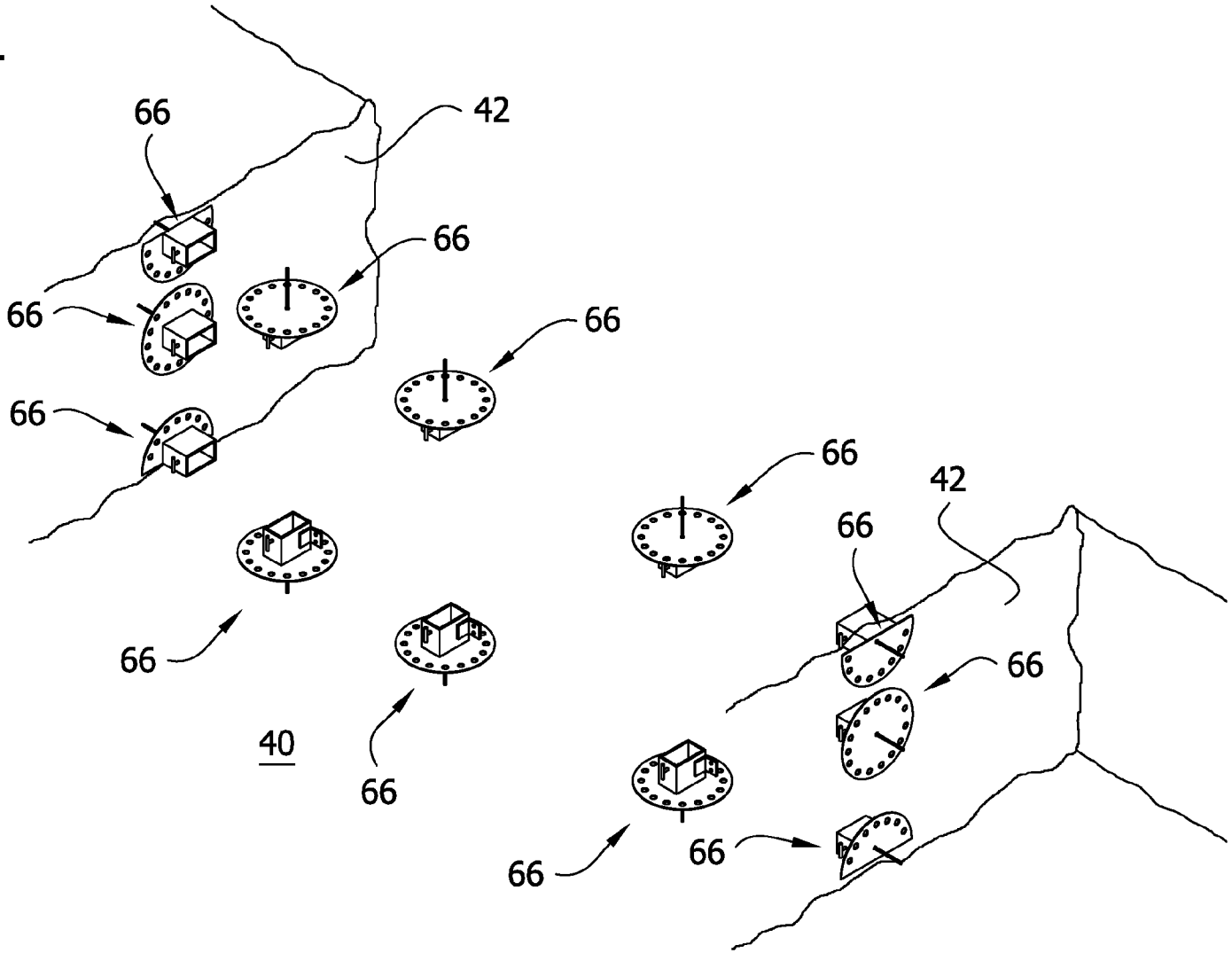
Figure 25:
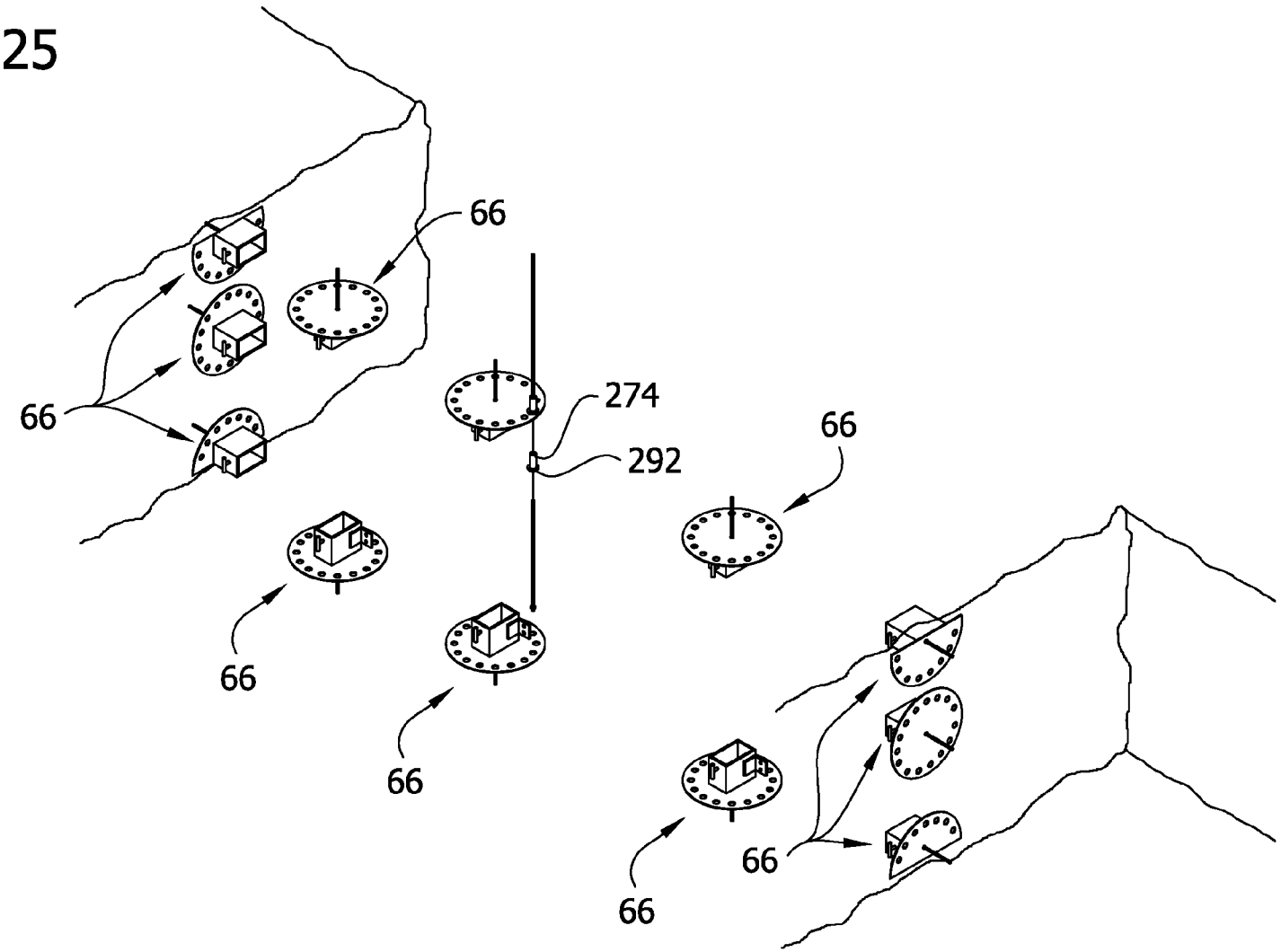
Figure 26:
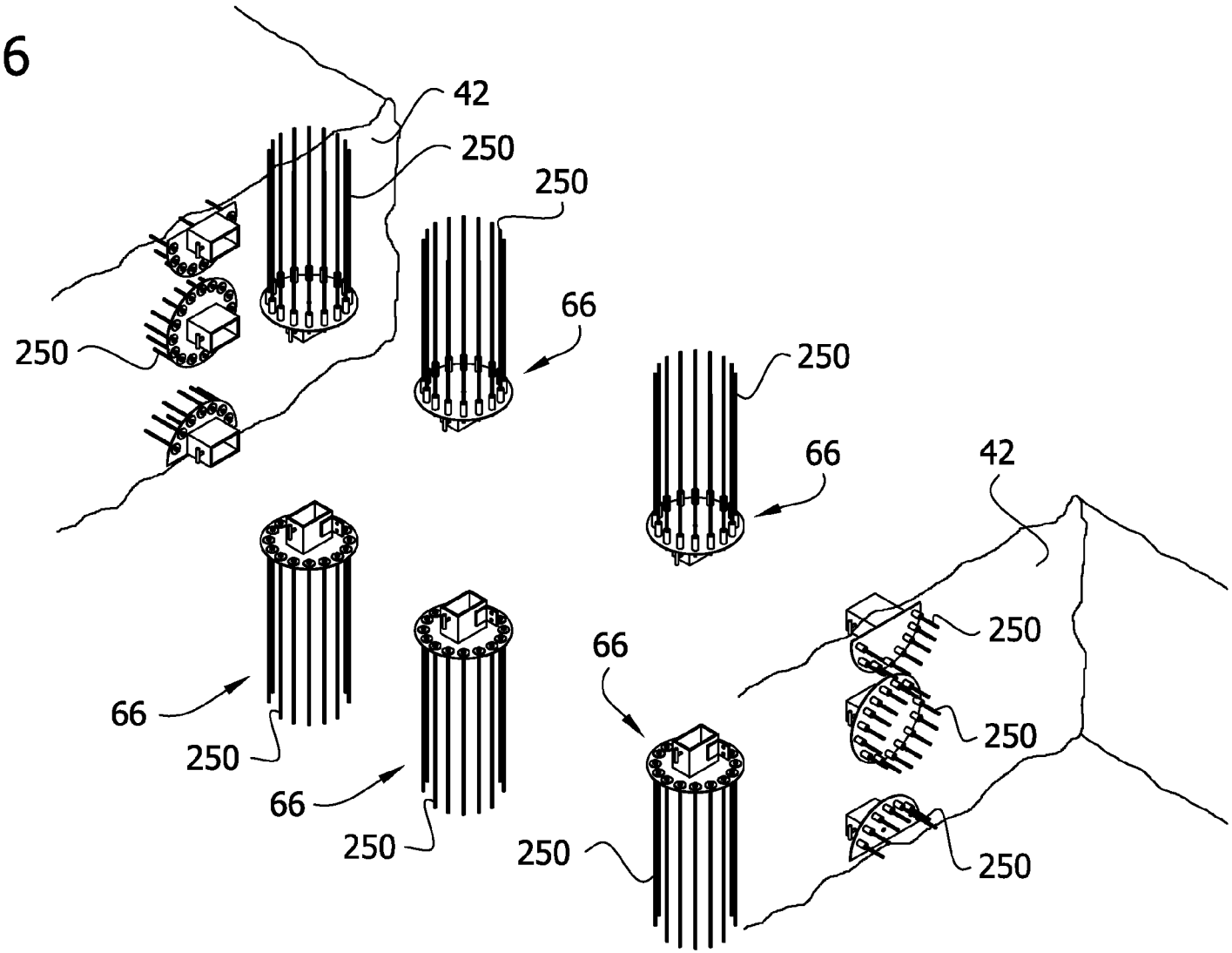

In FIG. 22, bottom side wall (rib) anchor units 66 are temporarily anchored (using center bolts 306 only) to respective side walls 42 of the room 40 directly and exactly across from one another so that back walls of the socket members 214 are flush (co-planar) with the front walls of the socket members of the floor anchor units. After the bottom side wall anchor units 66 are installed, middle and top side wall anchor units 66 are temporarily installed using the same process (FIGS. 23 and 24).

After all of the roof, floor, and side wall anchor units 66 are temporarily mounted at the correct locations, each anchor unit is anchored to the mine strata using the anchoring process described above (FIGS. 25 and 26). The fasteners 260 on the anchor bolts 250 are fully tightened to secure the anchor plates 210 to the anchor bolts.

Figure 28:
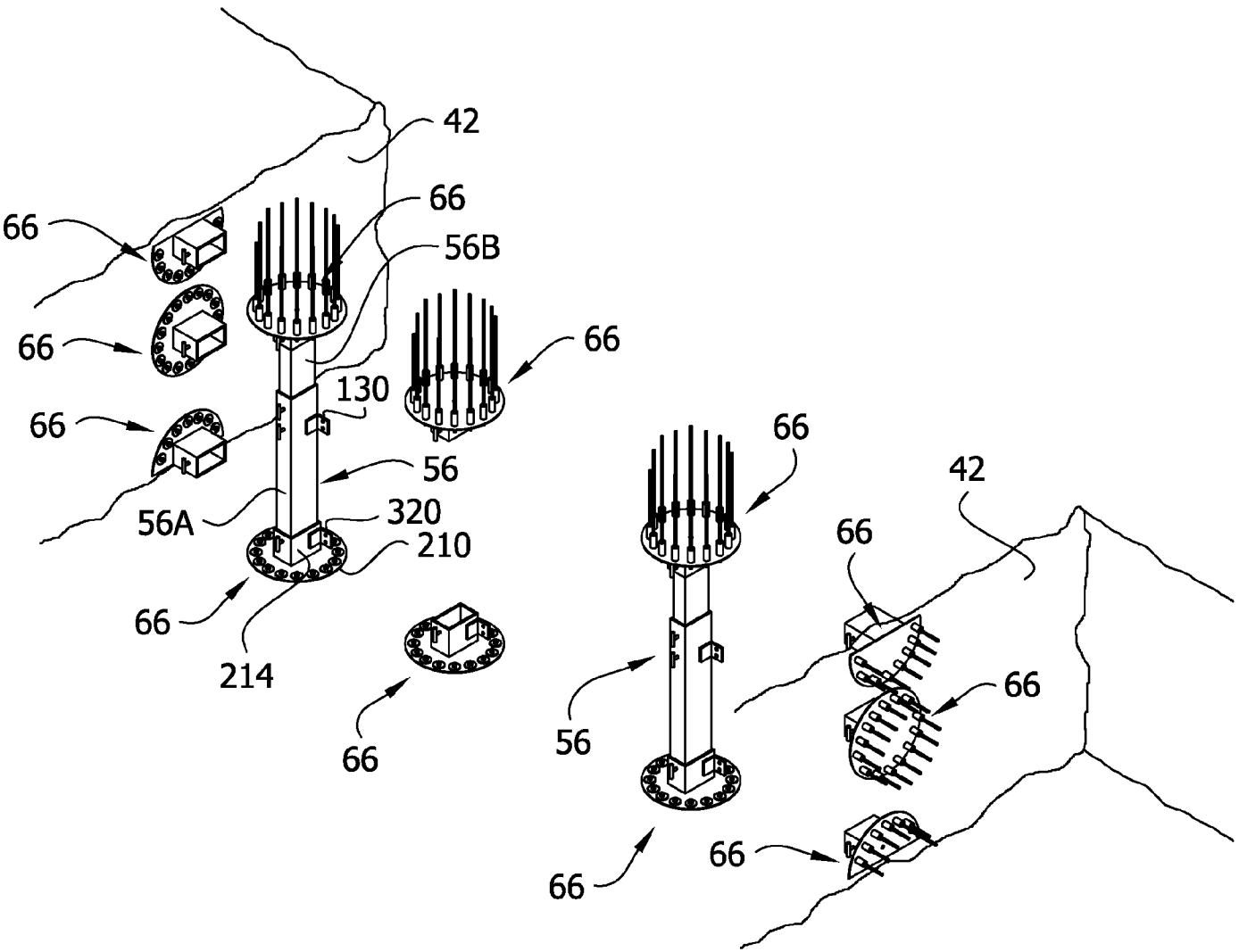

With the anchor units 66 bolted in place, the vertical columns 56 are installed. In FIG. 27, the lower outer section 56A of the left column 56 is inserted into the upward-opening socket member 214 of the left floor anchor unit 66. The T-handle set screws should be facing toward the inside of the safe room 40, and the protruding legs of the angle brackets 130 to be attached to the girders 58 should be positioned adjacent the front of the column. Using a suitable jack, the upper inner section 56B of the column is telescoped up into the downward-opening socket member 214 of the left roof anchor unit 66. The socket member set screws 234 of the unit 66 are tightened by a wrench or hammer to secure the upper and lower ends of the column 56 in respective roof and floor socket members 214, and the column set screws 124 are tightened in the same way to secure the inner and outer column sections 56A, 56B together. The right column is installed in the same manner (FIG. 28). One jack suitable for use is the jack described in co-assigned U.S. Pat. No. 7,438,506, incorporated herein by reference. Other jacking mechanisms may be used.

Figure 29:
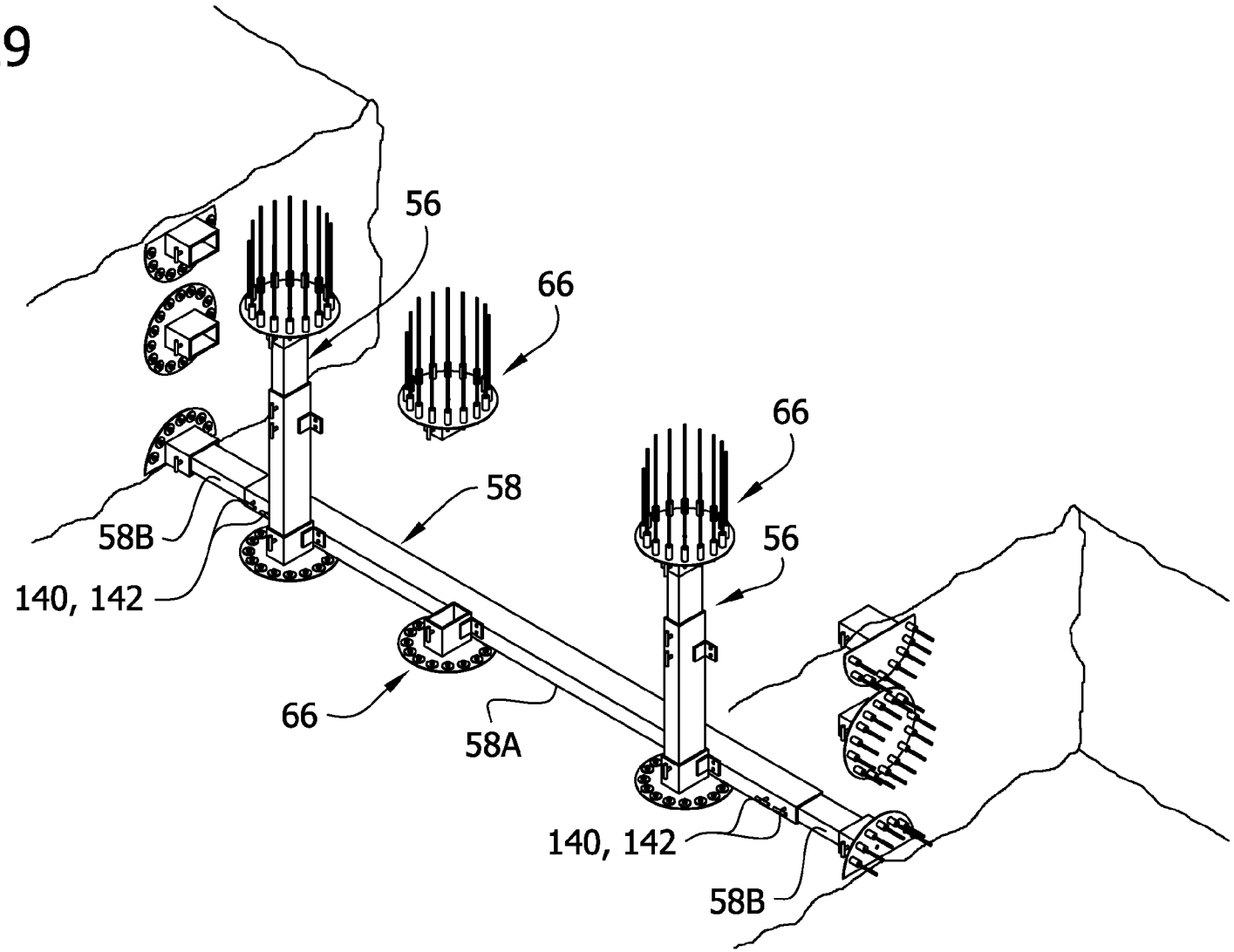

The bottom girder 58 is installed after the right and left columns 56 are anchored in place. In FIG. 29, the girder 58 is positioned on the floor in front of the columns 56 and secured to the floor anchor units 66 using the brackets 320 and suitable fasteners 324. The end sections 58B of the girders 58 are telescoped into respective socket members 214 of the bottom side wall anchor units 66, and the set screws 234 on the socket members are tightened (using a wrench or hammer) to secure the end sections in the socket members. The set screws 140 are also tightened to secure the inner end sections 58B in proper position relative to the outer center section 58A of the girder.

Figure 30:
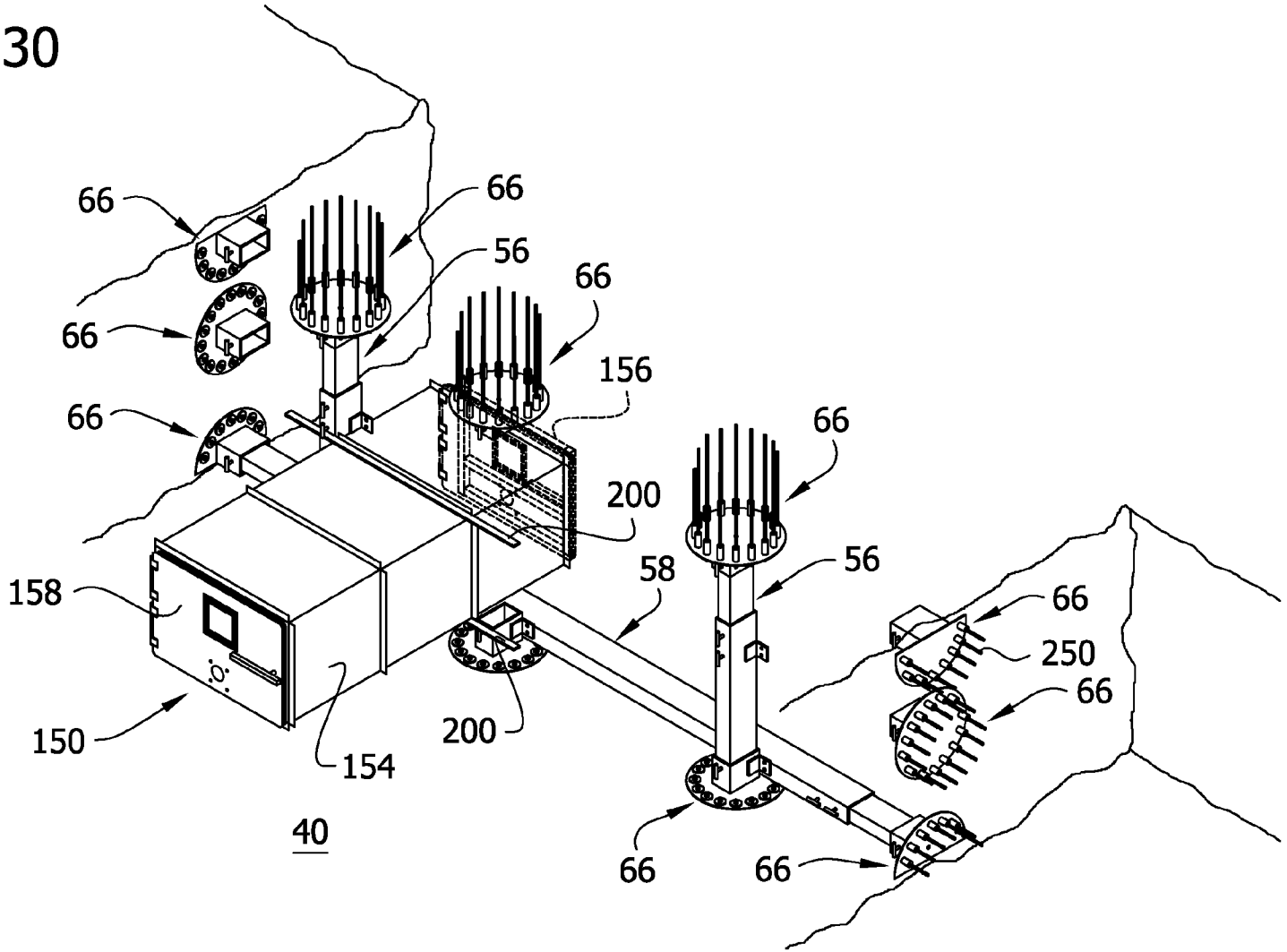

In FIG. 30, the door unit 150 is placed on top of the bottom girder 58 with the upper and lower stiffening bars 200 on the tunnel 154 butted up against the back of the left vertical column 56. The door unit 150 is oriented with the reinforced outer door 156 facing the outside of the safe room 40.

Figure 31:
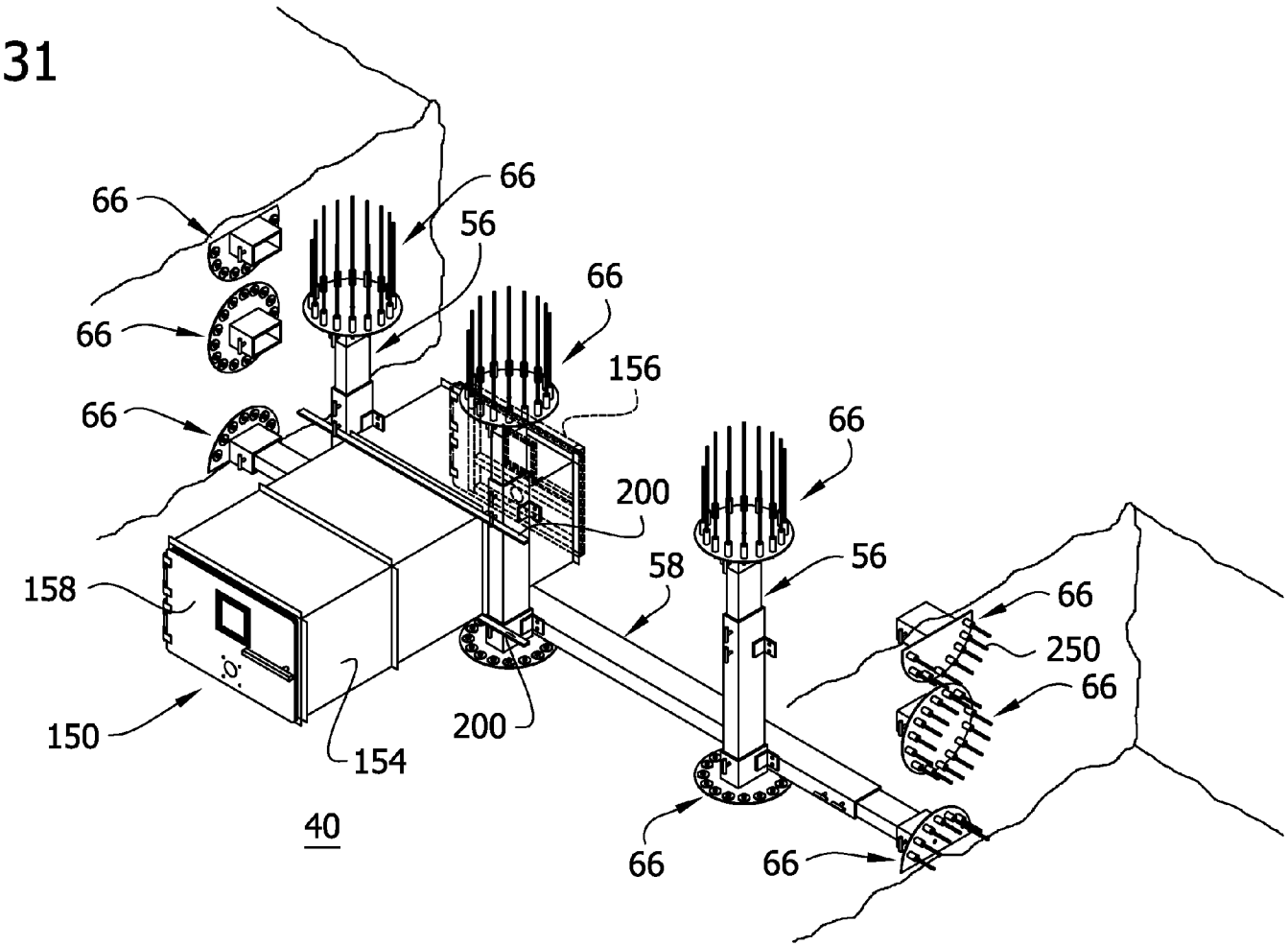

In FIG. 31, the center (middle) column 56 is installed in the same manner as the left column.

Figure 32:
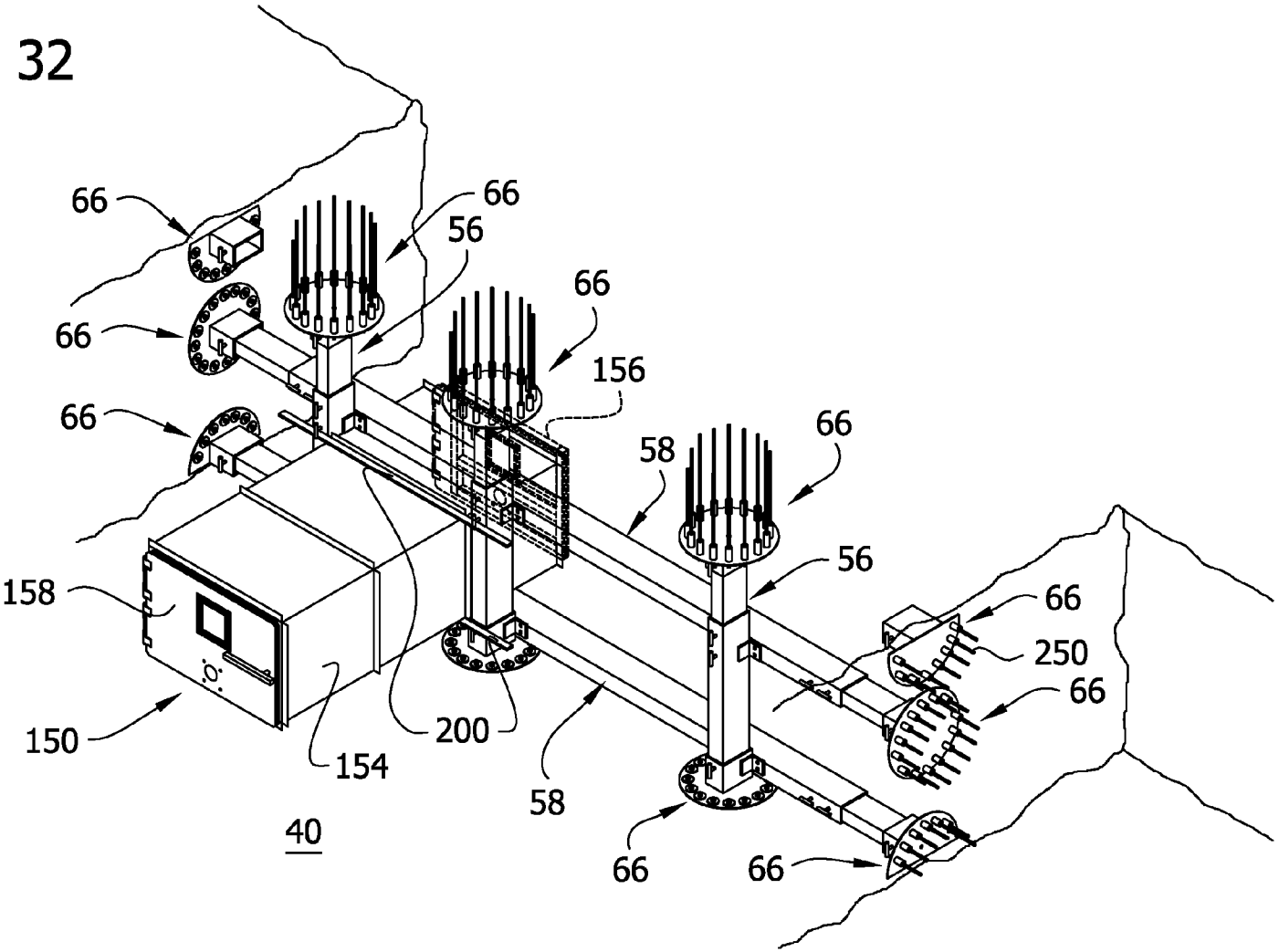

In FIG. 32, the center (middle) girder 58 is installed in essentially the same way as the bottom girder is installed. The girder brackets 130 on the columns 56 are used to attach the middle girder to the columns.

Figure 33:
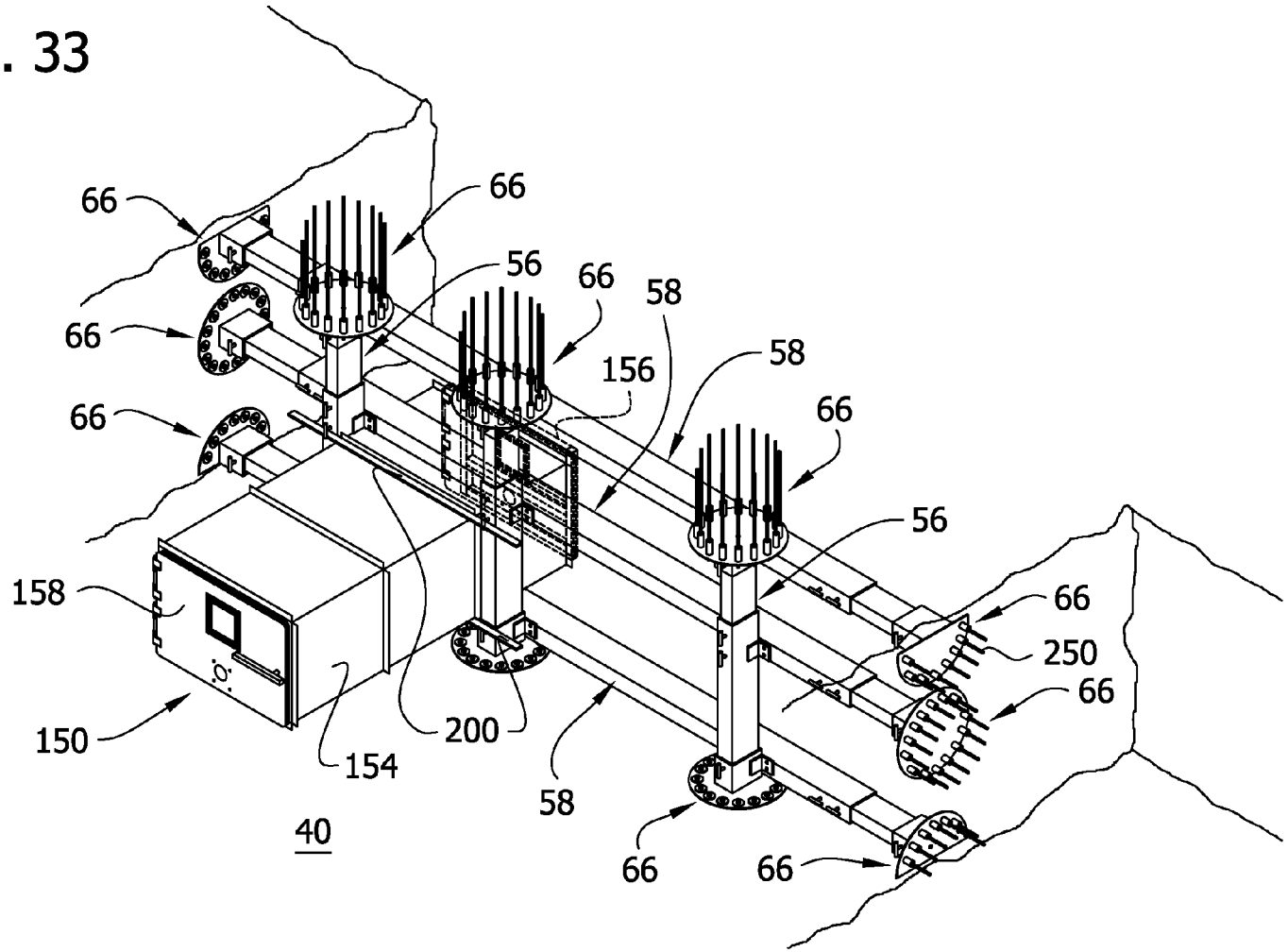

In FIG. 33, the top girder 58 is installed in essentially the same way as the bottom and center girders 58 are installed. The girder brackets 320 on the roof anchor units 66 are used to attach the top girder 58 to the anchor units.

Figure 34:
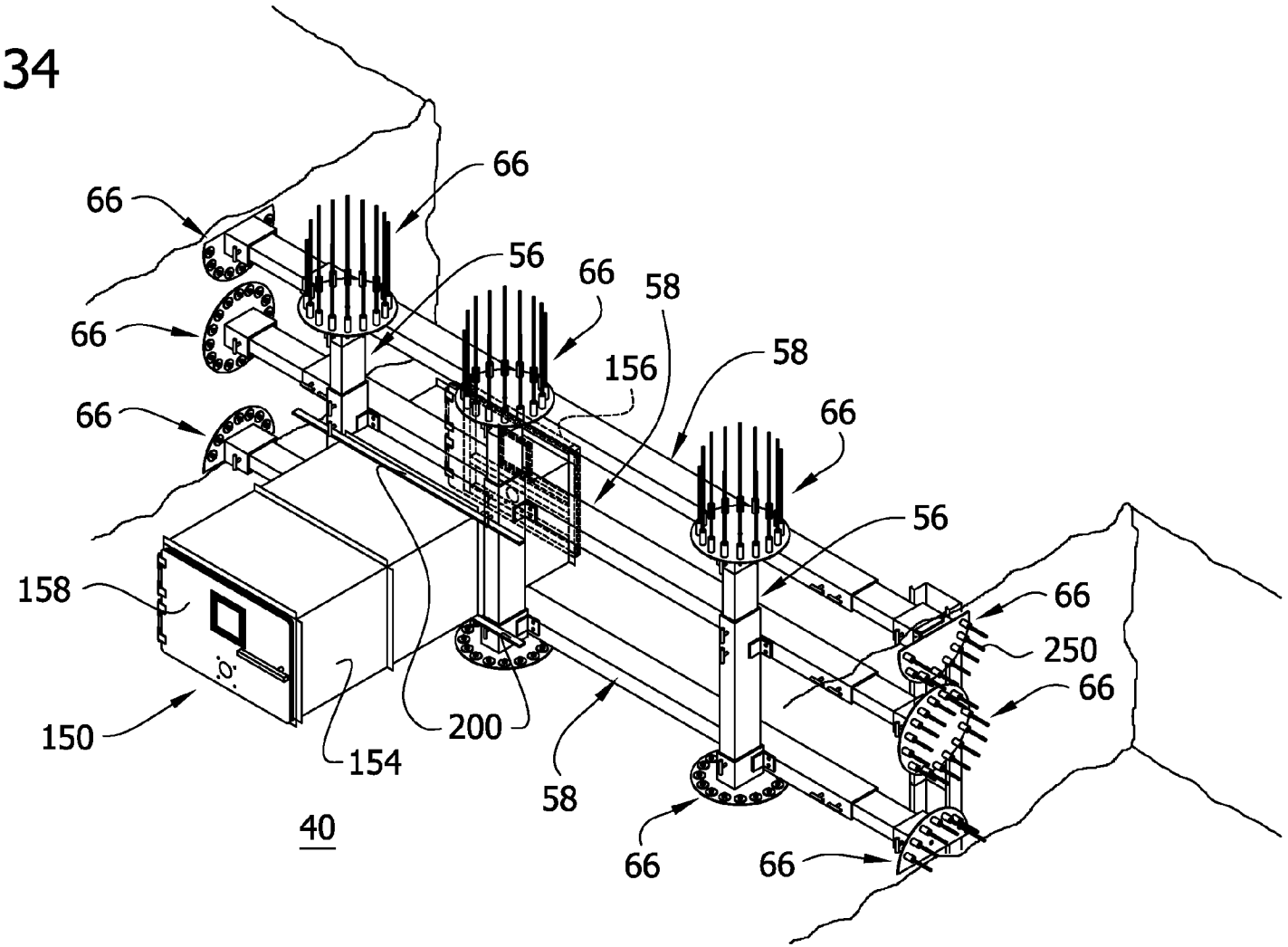

FIG. 34 illustrates the first step in installing the panels 70 of the bulkhead 50. In this process, a suitable panel 70 (e.g., capable of withstanding 15 psi) is placed against the right side wall (rib) 42 of the safe room 40 with the inner panel member 70A down and the flat web 74 of the panel toward the outside of the safe room. The panel 70 is extended (as by a jack) so that the upper panel member 70B is tight against the roof 44. A panel clamp 90 is placed on the top girder 58 with the hooks 100 on the clamp hooking over the lip 82 of the in-turned flange portion 80 of the upper panel member 70B, and the panel clamp set screws 106 are tightened to cause the hooks of the clamp to grip the panel lip 82. The jack is then released to allow the lower panel member 70A to move freely. The horizontal joint 114 between the upper and lower panel members 70A, 70B is sealed using suitable sealant (e.g., silicone caulking). After sealing, the jack is used to force the upper and lower ends of the panel 70 tightly against the roof 44 and floor 46. Panel clamps 90 are then installed over the middle and bottom girders 58 and tightened to grip the lips 82 of the in-turned flange portions 80 of the panel 70.

After the first panel 70 is installed, a bead of sealing material (e.g., silicone caulking) is placed on the out-turned flange portions 88 of the panel 70. A second panel 70 is placed alongside the first panel with the in-turned flange portions 80 and lips 82 of the second panel in overlapping engagement with the sealant on the out-turned flange portions 88 of the first panel. After this first vertical panel joint 110 is formed, the second panel 70 is extended (e.g., jacked) tightly against the roof 44. With the first and second panels 70 both tight against the roof, a panel clamp 90 is placed on the top girder 58 with the hooks 100 of the clamp hooked over the overlapping lips 82, 90 of the first and second panels at the first panel joint 110. The panel clamp set screws 106 are tightened to cause the hooks 100 of the clamp 90 to grip the panel lips. Two more clamps 90 are similarly installed on the center and bottom girders 58 to clamp the first vertical panel joint 110 at these locations.

Figure 35:
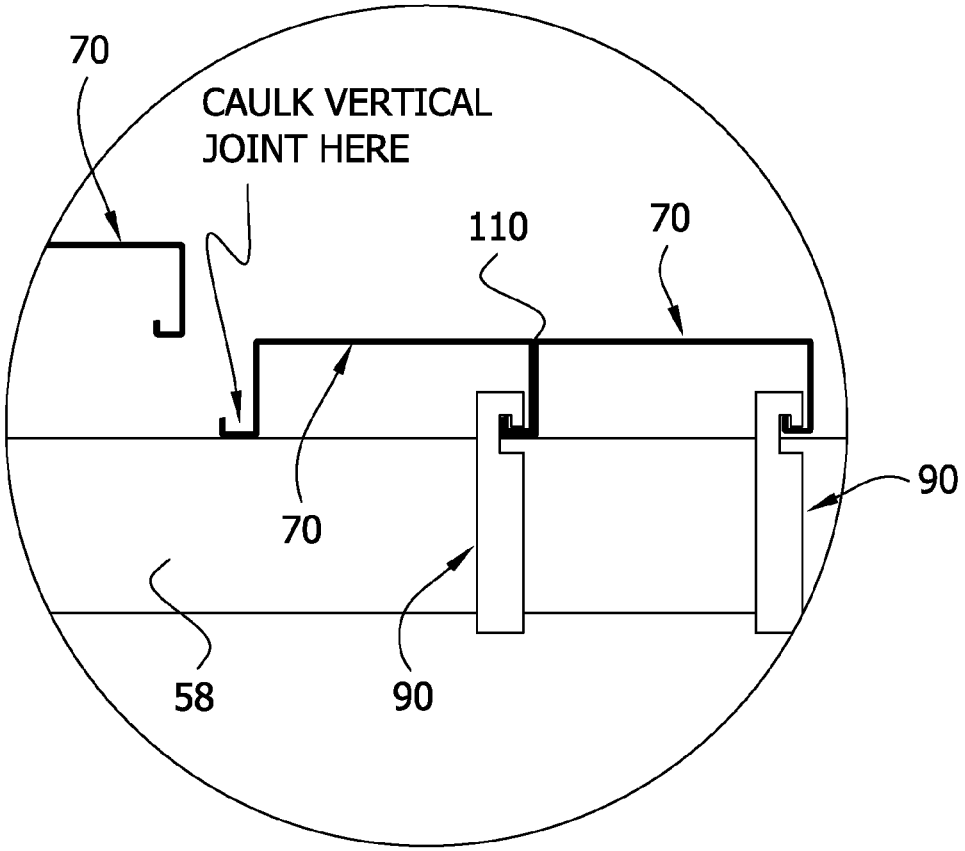

The above steps are repeated to install the remaining panels 70 across the front of the safe room to form the bulkhead 50 (see FIG. 35). The perimeter regions of the panels are sealed using a suitable sealant on both sides. By way of example, a foam material (e.g., a class one polyurethane foam) may be used as the sealant. The foam adheres to the steel and rib, roof and floor, and has significant strength in its installed state. Anchorage of the structure is gained when the foam is applied.

Optionally, the panels 70 may be equipped with upper and lower sealing members such as those described in the aforementioned co-assigned U.S. Pat. No. 7,438,506. When the panels 70 are jacked tight against the roof and floor, as described above, these sealing members deform to provide additional sealing between the mine strata and the panels.

After completion, a leakage test may be performed to ensure that the safe room is air tight. The provisions, atmospheric purge and maintenance (oxygen supply, CO2 scrubber, etc.) are not a part of the bulkhead and are provided as separate equipment. The entire bulkhead structure is designed to take roof to floor convergence and pillar expansion within its design range without unacceptable overloading of the structure through geological preload. Because of the telescopic nature of the structure, a range of heights and widths can be accommodated by varying telescopic extents. Five height ranges are typical, 3' to 5', 4' to 7', 5' to 9', 6' to 10', and 7' to 12'. Width ranges are typically 16' to 24'. Other ranges are contemplated.

Having described the invention in detail, it will be apparent that the bulkhead 50 and anchor unit 66 construction described above has a number of advantages. The anchor units 66 provide high-strength connection of supports (e.g., columns 56 and girders 58) to mine strata. The anchor units 66 are especially useful in constructing safe room bulkheads of the type described above. However, the anchor units 66 can be used to secure any type of support to mine strata. As a result, the anchor units and systems of this invention can be used in virtually any high-pressure application. Further, the socket construction of the anchor units allows for rapid disassembly and recovery of components of the system (e.g., bulkhead). While the anchor units 66 can certainly be removed, this construction gives the option of not disturbing an anchorage that may be containing roof or rib pressures that would be released should the anchor bolts 250 simply be cut during recovery operations.

The number of anchor units 66 used in any given installation will vary. Typically, however, an anchor unit is used to anchor each end of a support to adjacent mine strata. Similarly, the number of columns 56 and girders 58 used in a bulkhead will vary from one installation to another. Typically, each bulkhead will include at least one column and at least one girder. However, in some applications (e.g., where the opening to be walled off is narrow), there may be no need for a column. The size of the various components of the anchor units 66 and other elements of the bulkhead 50 will vary depending on such factors as the size of the opening to be walled off, the strength of the mine strata, and the pressures to be resisted.

As described above, a bulkhead of this invention can be used to wall off the open side of an adit to create a safe room. Alternatively, two bulkheads can be used to create spaced apart walls in a mine passage (e.g., an ordinary crosscut) to create a safe room.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above constructions and methods without departing from the scope of the invention, it is intended that all matter contained in the above description and shown in the accompanying drawings shall be interpreted as illustrative and not in a limiting sense.

What is claimed is:

1. A high-strength anchor system for anchoring a support to mine strata, said system comprising an anchor plate adapted to be secured to mine strata with an outer face of the plate facing the mine strata and an inner face of the plate facing away from the mine strata, a connecting member on the inner face of the anchor plate for connection of the support to the anchor plate, anchor bolt holes in the anchor plate spaced at intervals around the plate, anchor bolts extending through the bolt holes in the anchor plate into bore holes in the mine strata, fasteners for securing the anchor plate to the anchor bolts, and load-spreading devices extending from respective bolt holes in the anchor plate into respective bore holes in the mine strata, said load-spreading devices having outside diameters larger than outside diameters of the anchor bolts for spreading shear loads exerted on the anchor bolts over larger areas of the mine strata.

2. The anchor system set forth in claim 1, wherein each load-spreading device comprises a sleeve positioned in a respective bolt hole in the anchor plate, the sleeve having an inside surface defining a sleeve opening having an inside diameter sized to receive a respective anchor bolt and an outside surface.

3. The anchor system set forth in claim 2, further comprising an annular flange on the sleeve for engaging the inner face of the anchor plate, the annular flange defining a flange opening that is generally co-axial with the bolt hole in the anchor plate and sized for a close clearance reception of a respective anchor bolt to hold the anchor bolt centered in the bolt hole.

4. The anchor system set forth in claim 2, wherein the outside diameter of the sleeve is at least 0.5 in. greater than said outside diameter of the anchor bolt.

5. The anchor system set forth in claim 1, further comprising centering devices on the anchor plate for centering the anchor bolts in the anchor bolt holes.

6. The anchor system set forth in claim 5, wherein each centering device comprises an annular flange on the anchor plate defining a flange opening that is generally co-axial with the anchor bolt hole and sized for close clearance reception of a respective anchor bolt to hold the anchor bolt centered in the bolt hole.

7. The anchor system set forth in claim 1, further comprising a locating device on the anchor plate for holding the plate in a selected position on the mine strata prior to drilling said bore holes.

8. The anchor system set forth in claim 7, wherein said locating device comprises a bolt hole in a center region of the plate.

9. The anchor system set forth in claim 1, wherein the connecting member is configured for a telescoping fit with the support, and wherein the bolt holes in the anchor plate are spaced at intervals around the plate in an outer region of the plate between the connecting member and a peripheral edge of the plate.

10. The anchor system set forth in claim 9, wherein the connecting member comprises a socket member for receiving the support.

11. The anchor system set forth in claim 10, wherein the socket member has a girder bracket attached thereto for attachment of a girder to the socket member.

12. The anchor system set forth in claim 10, wherein the socket member has a set screw for securing a support in the socket member.

13. A high-strength anchor unit for anchoring a support to mine strata, said anchor unit comprising an anchor plate adapted to be secured to mine strata with an outer face of the plate facing the mine strata and an inner face of the plate facing away from the mine strata, a connecting member on the inner face of the anchor plate for connection of the support to the anchor unit, anchor bolt holes in the anchor plate spaced at intervals around the plate for receiving anchor bolts extending into bore holes in the mine strata, and load-spreading sleeves extending from respective bolt holes in the anchor plate for reception in respective bore holes in the mine strata, said sleeves having inside diameters sized for receiving respective anchor bolts and outside diameters greater than the inside diameters for spreading shear loads exerted on the anchor bolts over larger areas of the mine strata.

14. A method of anchoring a support to mine strata, comprising placing an anchor unit on the mine strata, using bolt holes in the anchor unit as guides to drill bore holes in the mine strata, inserting anchor bolts through the bolt holes into respective bore holes, surrounding each anchor bolt with a load-spreading device having an outside diameter greater than said outside diameter of the anchor bolt for spreading shear loads exerted on the anchor bolts over larger areas of the mine strata, fixing the anchor bolts in the bore holes, and securing the anchor plate to the anchor bolts in preparation for connecting a support to the anchor plate.

15. The method of claim 14, wherein said load-spreading device comprises a sleeve on the anchor plate extending into a respective bore hole, said sleeve having an inside diameter sized for receiving a respective anchor bolt.

16. The method of claim 14, further comprising holding the anchor bolts centered in respective bore holes during said fixing.

17. The method of claim 16, wherein said anchor bolts are held centered by centering devices on the anchor plate.

18. The method of claim 14, further comprising connecting a support to the anchor unit, and securing a wall structure to the support to form a bulkhead in a mine.

19. The method of claim 18, wherein the bulkhead defines one wall of a safe room in the mine.

20. A bulkhead for a safe room in a mine, the bulkhead comprising:

a wall structure extending between side walls of the safe room;

a support supporting the wall; and an anchor system anchoring the support to mine strata, said anchor system comprising an anchor plate anchored to the mine strata with an outer face of the plate facing outside of the safe room and an inner face of the plate facing inside the safe room, a connecting member on the inner face of the anchor plate connecting the support to the anchor plate, anchor bolt holes in the anchor plate spaced at intervals around the plate, anchor bolts extending through respective anchor bolt holes into bore holes in the mine strata, fasteners securing the anchor plate to the anchor bolts, and load-spreading devices extending from respective anchor bolt holes in the anchor plate into respective bore holes, said load-spreading devices having outside diameters larger than outside diameters of the anchor bolts for spreading shear loads exerted on the bolts over larger areas of the mine strata.

21. The bulkhead set forth in claim 20, wherein each load-spreading device comprises a sleeve positioned in a respective anchor bolt hole in the anchor plate, the sleeve having an inside surface defining a sleeve opening having an inside diameter sized to receive a respective anchor bolt and an outside surface having said outside diameter greater than said inside diameter.

22. The bulkhead set forth in claim 20, further comprising centering devices on the anchor plate for centering the anchor bolts in the anchor bolt holes.

23. The bulkhead set forth in claim 22, wherein each centering device comprises an annular flange on the anchor plate defining a flange opening that is generally co-axial with the anchor bolt hole and sized for close clearance reception of a respective anchor bolt to hold the anchor bolt centered in the anchor plate hole.

24. The bulkhead set forth in claim 20, further comprising a bolt hole in a center region of the plate for receiving a bolt to hold the anchor plate in a selected position on the mine strata prior to drilling said anchor bolt bores.

25. The bulkhead set forth in claim 20, wherein the wall structure comprises a plurality of elongate vertical panels positioned side-by-side, each panel comprising upper and lower panel members having a telescoping fit, and clamps for clamping the panels to the support.

26. The bulkhead set forth in claim 25, wherein the panels have in-turned overlapping stiffening flanges, and wherein each clamp is generally U-shaped and defines a recess that receives the support, the clamp having an upper arm extending generally horizontally over the support, a lower arm extending generally horizontally under the support, and hooks on the arms for hooking onto the overlapping flanges of respective panels.

27. The bulkhead set forth in claim 26, wherein the arms of each clamp are connected by a generally vertical web having at least one screw hole therein offset from the vertical center of the web for receiving a screw to secure the clamp to the support.

28. The bulkhead set forth in claim 25, wherein the wall structure comprises a door unit sealed against surfaces of the panels facing outside the safe room.

* * * * *